US010562032B2

(12) United States Patent
Honkanen et al.

(10) Patent No.: US 10,562,032 B2
(45) Date of Patent: Feb. 18, 2020

(54) SYSTEMS AND METHODS FOR AUTOMATIC PLATE WASHING

(71) Applicant: Aushon Biosystems, Inc., Billerica, MA (US)

(72) Inventors: Peter Honkanen, Concord, MA (US); David Bradbury, Barnstead, NH (US)

(73) Assignee: Aushon Biosystems, Inc., Billerica, MA (US)

( * ) Notice: Subject to any disclaimer, the term of this patent is extended or adjusted under 35 U.S.C. 154(b) by 203 days.

(21) Appl. No.: 15/606,881

(22) Filed: May 26, 2017

(65) Prior Publication Data

US 2018/0339296 A1 Nov. 29, 2018

(51) Int. Cl.

| | |
|---|---|
| ***B08B 3/02*** | (2006.01) |
| ***B08B 9/093*** | (2006.01) |
| ***B01L 99/00*** | (2010.01) |

(52) U.S. Cl.

CPC ..... *B01L 99/00* (2013.01); *B08B 3/022* (2013.01); *B08B 9/093* (2013.01)

(58) Field of Classification Search

CPC ..... B08B 3/022; B08B 3/024; B08B 9/00; B08B 9/093; B01L 2300/0829; B01L 2300/0893; B01L 9/523; B01L 99/00; G01N 35/028; G01N 2035/042; G01N 2035/0437

See application file for complete search history.

(56) References Cited

U.S. PATENT DOCUMENTS

| | | | | |
|---|---|---|---|---|
| 3,861,061 | A | 1/1975 | Ross | |
| 6,692,703 | B2 * | 2/2004 | Shoji | B01L 3/0275 422/52 |
| 8,020,571 | B2 | 9/2011 | Honkanen et al. | |
| 8,152,930 | B2 | 4/2012 | Massaro | |
| 8,246,760 | B2 | 8/2012 | Honkanen et al. | |
| 8,679,262 | B2 | 3/2014 | Honkanen et al. | |
| 8,685,486 | B2 | 4/2014 | Oliver et al. | |

(Continued)

FOREIGN PATENT DOCUMENTS

| | | | |
|---|---|---|---|
| EP | 2 835 178 A1 | 2/2015 | |
| WO | WO-2006017737 A2 * | 2/2006 | B08B 9/08 |

(Continued)

OTHER PUBLICATIONS

International Search Report and Written Opinion for PCT/US2018/034727 dated Aug. 7, 2018.

*Primary Examiner* — Marc Lorenzi

(74) *Attorney, Agent, or Firm* — Wolf, Greenfield & Sacks, P.C.

(57) ABSTRACT

The present disclosure relates to automated systems and methods for washing microtiter plates that offer advantages such as increased efficiency and decreased contamination during the washing process. In an exemplary embodiment, an automated system for washing multiwell plates comprises an arm having a metal portion and having a multiwell plate holder for holding a multiwell plate; a first rotational servo configured to rotate the multiwell plate about a first axis; a second rotational servo configured to rotate the arm about a second axis; and a controller configured to operate the system to dispels fluid in the multiwell plate.

12 Claims, 29 Drawing Sheets

(56) References Cited

U.S. PATENT DOCUMENTS

| | | | | |
|---|---|---|---|---|
| 8,784,752 | B2 * | 7/2014 | Kim | B01L 3/5088 134/56 R |
| 8,811,704 | B2 | 8/2014 | Honkanen et al. | |
| 2004/0200509 | A1 * | 10/2004 | Felder | B08B 3/02 134/26 |
| 2004/0208790 | A1 | 10/2004 | Daf | |
| 2005/0170512 | A1 * | 8/2005 | Rubin | A61L 2/18 436/43 |
| 2008/0105515 | A1 | 5/2008 | Damick et al. | |
| 2010/0294319 | A1 * | 11/2010 | Massaro | B08B 3/02 134/23 |
| 2012/0006363 | A1 * | 1/2012 | Milojevic | B08B 3/022 134/62 |
| 2013/0019697 | A1 * | 1/2013 | McKeen | G01N 1/312 73/863.21 |
| 2013/0142710 | A1 | 6/2013 | Honkanen et al. | |
| 2013/0266969 | A1 | 10/2013 | Honkanen et al. | |
| 2014/0134652 | A1 | 5/2014 | Honkanen et al. | |
| 2018/0120310 | A1 | 5/2018 | Honkanen et al. | |

FOREIGN PATENT DOCUMENTS

| | | | |
|---|---|---|---|
| WO | WO 2010/120249 | A1 | 10/2010 |
| WO | WO 2010/134964 | A1 | 11/2010 |

* cited by examiner

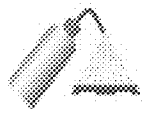

Step 1. Add ≥ 300 μL of wash buffer to each well and dump the plate. Repeat three more times for a total of four washes.

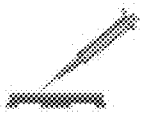

Step 2. Add 50 μL of diluted Standards or diluted samples to each well.

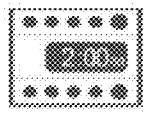

Step 3. Cover plate and shake at room temperature (20-25°C) for 2 hours.*

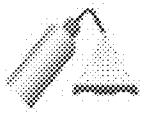

Step 4. Wash plate FOUR times.

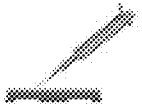

Step 5. Add 50 μL of Biotinylated Antibody Reagent to each well.

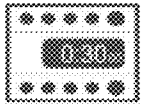

Step 6. Cover plate and shake at room temperature (20-25°C) for 30 minutes.*

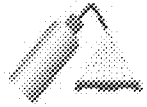

Step 7. Wash plate FOUR times.

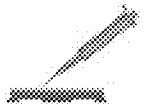

Step 8. Add 50 μL of Streptavidin-HRP Reagent to each well.

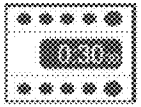

Step 9. Cover plate and shake at room temperature (20-25°C) for 30 minutes.*

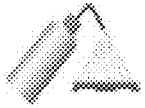

Step 10. Wash plate FOUR times.

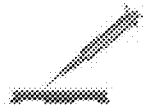

Step 11. Add 50 μL of the SuperSignal® Substrate to each well. Read luminescence using the Cirascan™ Imaging System.

Fig. 12

| | 1 | 2 | 3 | 4 | 5 | 6 | 7 | 8 | 9 | 10 | 11 | 12 |
|---|---|---|---|---|---|---|---|---|---|---|---|---|
| A | Standard 1 | Standard 1 | Sample 1 | Sample 1 | Sample 9 | Sample 9 | Sample 17 | Sample 17 | Sample 25 | Sample 25 | Sample 33 | Sample 33 |
| B | Standard 2 | Standard 2 | Sample 2 | Sample 2 | Sample 10 | Sample 10 | Sample 18 | Sample 18 | Sample 26 | Sample 26 | Sample 34 | Sample 34 |
| C | Standard 3 | Standard 3 | Sample 3 | Sample 3 | Sample 11 | Sample 11 | Sample 19 | Sample 19 | Sample 27 | Sample 27 | Sample 35 | Sample 35 |
| D | Standard 4 | Standard 4 | Sample 4 | Sample 4 | Sample 12 | Sample 12 | Sample 20 | Sample 20 | Sample 28 | Sample 28 | Sample 36 | Sample 36 |
| E | Standard 5 | Standard 5 | Sample 5 | Sample 5 | Sample 13 | Sample 13 | Sample 21 | Sample 21 | Sample 29 | Sample 29 | Sample 37 | Sample 37 |
| F | Standard 6 | Standard 6 | Sample 6 | Sample 6 | Sample 14 | Sample 14 | Sample 22 | Sample 22 | Sample 30 | Sample 30 | Sample 38 | Sample 38 |
| G | Standard 7 | Standard 7 | Sample 7 | Sample 7 | Sample 15 | Sample 15 | Sample 23 | Sample 23 | Sample 31 | Sample 31 | Sample 39 | Sample 39 |
| H | Standard 8 | Standard 8 | Sample 8 | Sample 8 | Sample 16 | Sample 16 | Sample 24 | Sample 24 | Sample 32 | Sample 32 | Sample 40 | Sample 40 |

Fig. 13

SYSTEMS AND METHODS FOR AUTOMATIC PLATE WASHING

TECHNICAL FIELD

This disclosure relates to automated systems and methods for washing microtiter plates.

BACKGROUND

An assay substrate is a surface upon which various chemical and/or biological analyses can be performed. Examples of an assay substrate include microarray plates, glass slides, and microtiter plates. A microtiter plate (also known as multiwell plate) is a plate that has multiple "wells" formed in its surface. Each well can be used as a small test tube into which various materials can be placed to perform biochemical analyses. One illustrative use of microtiter plates includes for conducting biochemical assays such as an enzyme-linked immunosorbent assay (ELISA), which is a modern medical diagnostic testing technique.

Multiwell plates are commonly used for biological research applications, particularly cellular and/or biochemical assays. Such assays or techniques may be conducted with high throughput, as multiwell plates commonly contain 96 or more separate wells where individual experiments may be conducted. After an assay is performed, an amount of residual material may be left in the wells. One technique for removing the residual material is to do so manually. Because various individuals may be performing the same task at different timepoints in the assay, even slight differences in how each individual may process the plate introduces inconsistent assay results, especially in highly sensitive assays. Contamination between wells may also occur throughout the wash process, compromising signal intensity and resulting in a need to run additional replicates of the same samples.

Another technique for removing residual material is to use plate washers that aspirate the residual material from the wells. For example, fluid is dispensed and aspirated by lowering twin sets of aspirate and dispense tubes from the top of the well plate multiple times. However, these automated plate washers have several disadvantages. For example, the aspirate needles often do not eliminate all of the residual material in the wells, compromising the wash process. Additionally, while this technique may be generally effective for the first few rounds of aspirating and dispensing, subsequent aspirations with the same tubes may contaminate the samples. Furthermore, aspirating and dispensing with twin sets of tubes is a time-consuming process.

Using another technique, a plate washer utilizes centripetal forces to expel the fluid from the wells. This technique does not use aspirate needles but also has several disadvantages. For example, this technique also expels the well's fluid onto the inner walls of the wash instrument, creating the potential for cross contamination of subsequently processed assay plates.

Because of the disadvantages of the current techniques for washing plates, a need exists for systems and methods to provide consistent washing of multiwell plates used for biochemical assays and techniques.

SUMMARY

The present disclosure relates to automated systems and methods for washing microtiter plates that offer advantages such as increased efficiency and decreased contamination during the washing process.

In one aspect, an automated system for washing multiwell plates comprises an arm having a metal portion and having a multiwell plate holder for holding a multiwell plate; a first rotational servo configured to rotate the multiwell plate about a first axis; a second rotational servo configured to rotate the arm about a second axis; and a controller configured to: operate the first rotational servo as a first closed loop servo to rotate the multiwell plate about the first axis from an upward position to a downward position; operate the second rotational servo as a second closed loop servo to rotate the arm about the second axis such that the metal portion moves towards a first electromagnet and to transition the second rotational servo to operating as an open loop servo; and activate the first electromagnet to cause the first electromagnet to pull the metal portion towards the first electromagnet while the second rotational servo operates as the open loop servo, wherein a deceleration impulse caused by the arm contacting a first stop dispels fluid in the multiwell plate.

In some embodiments, the first stop comprises the first electromagnet. In some embodiments, the first electromagnet magnet pulls the metal portion towards the first electromagnet and holds the metal portion against the first electromagnet magnet. In some embodiments, the metal portion comprises a metal plate. In some embodiments, the deceleration impulse caused by the metal portion contacting the first stop dispels fluid in the multiwell plate into at least one of a removal basin and absorbent material.

In some embodiments, the automated system further comprises a linear servo configured to move the arm between the removal basin and the absorbent material; wherein the controller is further configured to: operate the second servo as the second closed loop servo to rotate the arm about the second axis such that the metal portion moves towards a second electromagnet and transition the second servo to operating as the open loop servo; and activate the second electromagnet to pull the metal portion towards the second electromagnet while the second rotational servo operates as the open loop servo, wherein a deceleration impulse caused by the arm contacting a second stop dispels fluid in the multiwell plate into at least the other of the absorbent material and the removal basin.

In some embodiments, the controller activates the first electromagnet 20 to 40 milliseconds before the metal portion impacts the first electromagnet. In some embodiments, the absorbent material is placed on top of a support for the absorbent material. In some embodiments, the system further comprises a source wheel that supplies clean absorbent material to the support. In some embodiments, the system further comprises a take-up wheel that removes used absorbent material from the support. In some embodiments, the system further comprises a fluid manifold having a base and a plurality of dispense needles adapted to dispense wash fluid into a corresponding plurality of wells in the multiwell plate, the wash manifold being configured to dispense wash fluid across rows or columns of the multiwell plate. In some embodiments, the arm is configured to move along a linear axis allowing movement of the multiwell plate underneath the fluid manifold.

In another aspect, a method of washing multiwell plates using an automated system for washing multiwell plates comprises: operating a first rotational servo as a first closed loop servo to rotate a multiwell plate about a first axis from an upward position to a downward position; operating a second rotational servo as a second closed loop servo to rotate an arm about a second axis such that a metal portion moves towards a first electromagnet and transitioning the second rotational servo to operating as an open loop servo; and activating the first electromagnet to cause the first electromagnet to pull the metal portion towards the first electromagnet while the second rotational servo operates as the open loop servo, wherein a deceleration impulse caused by the arm contacting a first stop dispels fluid in the multiwell plate.

In some embodiments, the first stop comprises the first electromagnet. In some embodiments, the first electromagnet magnet pulls the metal portion towards the first electromagnet and holds the metal portion against the first electromagnet magnet. In some embodiments, the metal portion comprises a metal plate. In some embodiments, the deceleration impulse caused by the metal portion contacting the first stop dispels fluid in the multiwell plate into at least one of a removal basin and absorbent material.

In some embodiments, the method further comprises operating a linear servo to move the arm between the removal basin and the absorbent material; operating the second servo as the second closed loop servo to rotate the arm about the second axis such that the metal portion moves towards a second electromagnet and transition the second servo to operating as the open loop servo; and activating the second electromagnet to pull the metal portion towards the second electromagnet while the second rotational servo operates as the open loop servo, wherein a deceleration impulse caused by the arm contacting a second stop dispels fluid in the multiwell plate into at least the other of the absorbent material and the removal basin.

In some embodiments, the method further comprises activating the first electromagnet 20 to 40 milliseconds before the metal portion impacts the first electromagnet. In some embodiments, the absorbent material is placed on top of a support for the absorbent material. In some embodiments, the method further comprises operating a source wheel to supply clean absorbent material to the support. In some embodiments, the method further comprises operating a take-up wheel to remove used absorbent material from the support. In some embodiments, the method further comprises operating a fluid manifold having a base and a plurality of dispense needles to dispense wash fluid into a corresponding plurality of wells in the multiwell plate, the wash manifold being configured to dispense wash fluid across rows or columns of the multiwell plate. In some embodiments, the arm is configured to move along a linear axis allowing movement of the multiwell plate underneath the fluid manifold.

These and other aspects and embodiments of the disclosure are illustrated and described below.

BRIEF DESCRIPTION OF THE DRAWINGS

Exemplary embodiments are described with reference to the following figures, which are presented for the purpose of illustration only and are not intended to be limiting.

FIG. 12 depicts the steps involved in conducting an assay with a plate washing system according to an exemplary embodiment.

FIG. 13 illustrates an exemplary template for an assay plate layout.

DETAILED DESCRIPTION

Figure 1:
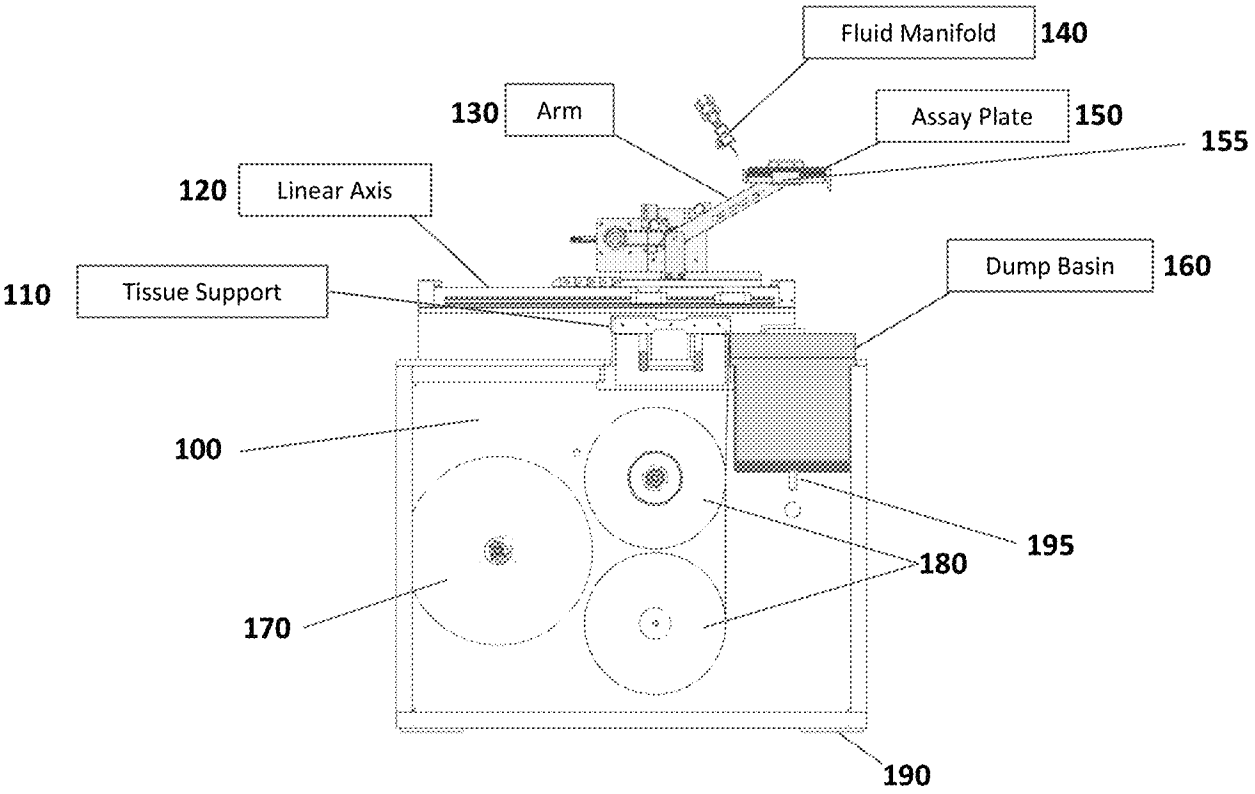
FIG. 1 is a side view of a plate washing system according to an exemplary embodiment.

The present disclosure relates to automated systems and methods for washing microtiter plates that offer advantages such as increased efficiency and decreased contamination during the washing process.

It will be appreciated that while a particular sequence of steps is described herein for purposes of explanation, the sequence may be varied in certain respects, or the steps may be combined, while still obtaining the desired configuration. Additionally, modifications to the disclosed embodiments are possible and within the scope of this disclosure.

All scientific and technical terms used herein, unless otherwise defined, are intended to have the same meaning as commonly understood by one of ordinary skill in the art. References to techniques employed herein are intended to refer to the techniques as commonly understood in the art, including variations on those techniques or substitutions of equivalent or later-developed techniques which would be apparent to one of skill in the art. In addition, to more clearly and concisely describe the subject matter described herein, the following explanations are provided for certain terms which are used in the specification and appended claims.

As used herein, the terms "microtiter plate," "assay plate," and "multiwell plate" are understood to include any microtiter or multiwell plate of 2, 6, 8, 24, 48, 96, 384, or 1536 well formats, or any other number of wells.

As used herein, the term "absorbent material" includes any type of material that can be used to wick fluid or moisture from the plate. The suitability of the material may depend on the plate material as well as the type of fluid to be removed from the plate. In some embodiments, the absorbent material may be a paper product such as tissue paper, such as but not limited to napkins, paper towels, or bath tissue. The tissue may also be of variable thickness. In other embodiments, the tissue may be any suitable cloth made from any suitable fabric, such as but not limited to cotton, polyester, nylon, felt, rayon, acetate, or wool. In further embodiments, the absorbent material can be made from either woven or knitted natural, cellulose, or synthetic cloth.

As used herein, the term "manifold" is used to describe a member used to dispense fluid into wells of a multiwell plate. The manifold may, for example, consist of a row or rows of 4, 8 or 16 pins or dispense tubes, each pin or dispense tube having an opening to allow passage of fluid.

As used herein, the term "fluid" includes a wash fluid, sample, reagent, or other liquids provided within each of the wells of an assay plate. The type of fluid used may depend on the type of residual material that is to be removed from the sample wells. In some embodiments, the fluid may be a liquid such as water, which may or may not also be distilled or deionized to any suitable degree. In other embodiments, the fluid may be or include a liquid such as an acid, a base, any suitable ionic solution, organic solvent, suspension, emulsion, or any combination thereof. Additionally, any combination of the above mentioned substances may be used as a fluid. Different fluids may also be flowed into the assay plate. Fluid may be distributed suitably as desired and does not have to be supplied to all the wells of an assay plate at once.

General Considerations

Embodiments of the present disclosure disclose automated systems and methods for washing microtiter plates. In some embodiments, the automated systems and methods address problems such as inconsistent washing of the plate due to cross contamination and ineffective removal of fluid from the plate's wells during the wash process.

In one embodiment, a manifold contains dispense tubes. The manifold may omit aspirate tubes or needles, eliminating the potential for cross contamination from aspirate needles entering multiple wells across multiple plates. A robotic or automatic mechanism may be used to impact plates onto a surface, such as a horizontal surface, to expel most or all residual material, such as fluid, from the wells. In some embodiments, this may advantageously enable the assays to achieve increased diagnostic precision and increased sensitivity.

In an exemplary embodiment of the present disclosure, a plate washer robotically washes microtiter assay plates (e.g., 96 or 384 well plates). A robot arm expels the fluid into a removal basin and subsequently dispels residual fluid from the well plate by impacting it onto an absorbent material such as multiple layers of tissue paper. In some embodiments, upon impact, the plate is parallel to a horizontal surface. The impact expels a substantial amount of fluid from the wells of the plate, which improves the diagnostic precision and sensitivity of the assays.

Figure 2:
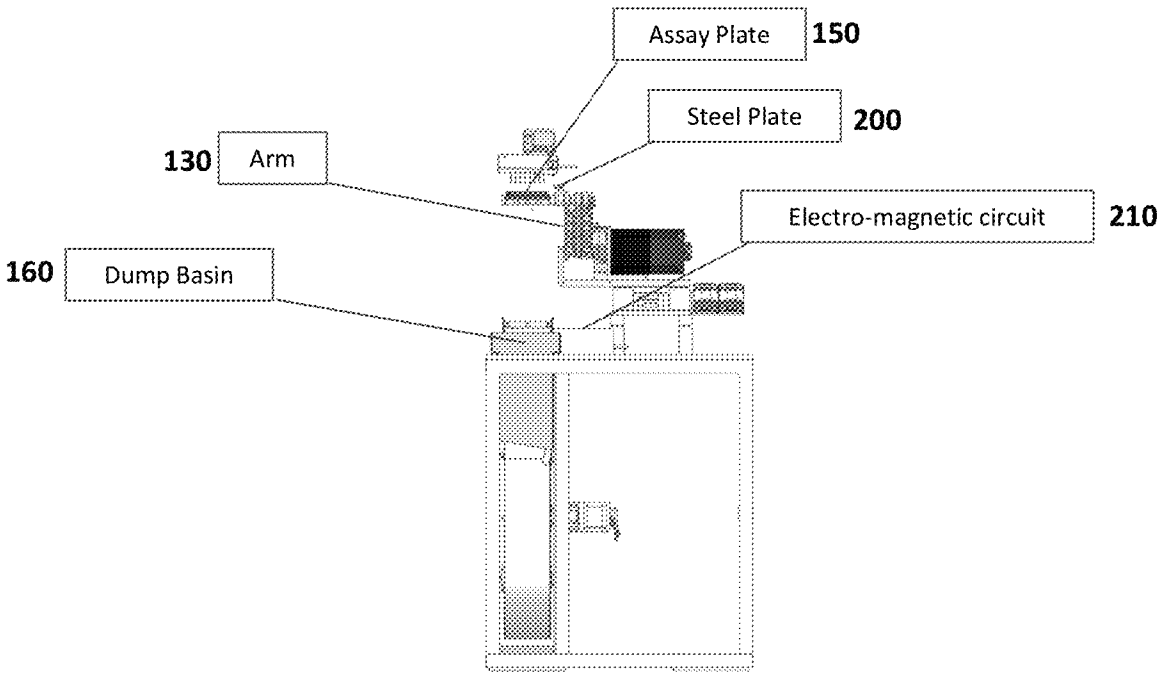
FIG. 2 is a front view of a plate washing system according to an exemplary embodiment.
Figure 3:
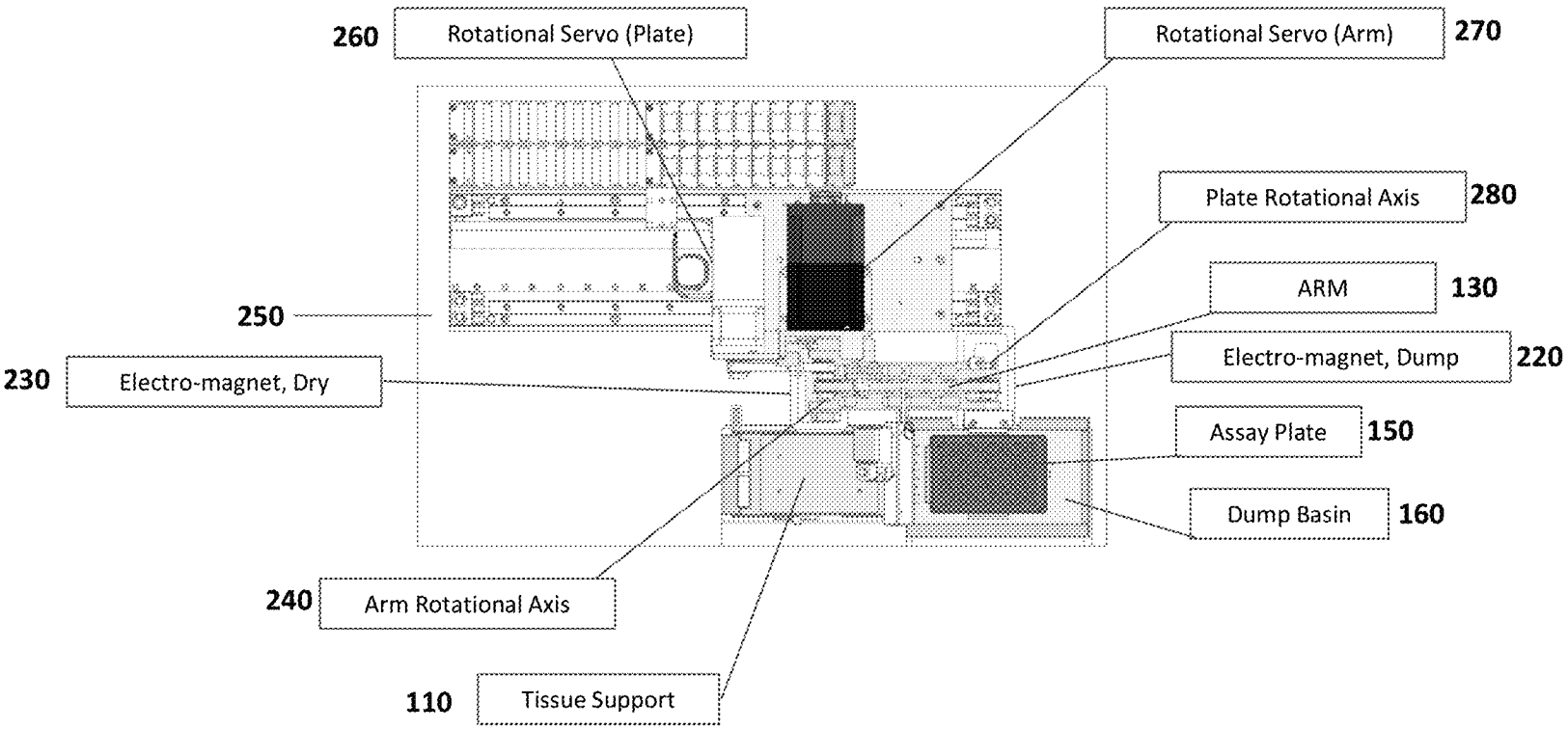
FIG. 3 is a top view of a plate washing system according to an exemplary embodiment.
Figure 4:
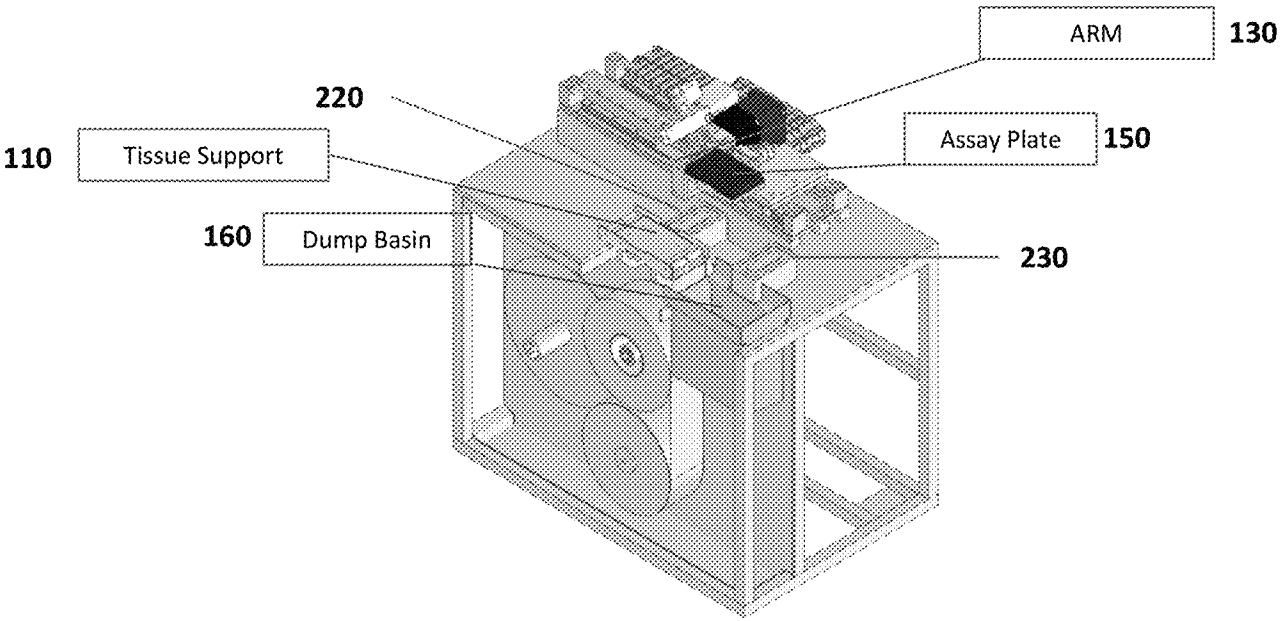
FIG. 4 is an orthogonal view of a plate washing system according to an exemplary embodiment.
Figure 5:
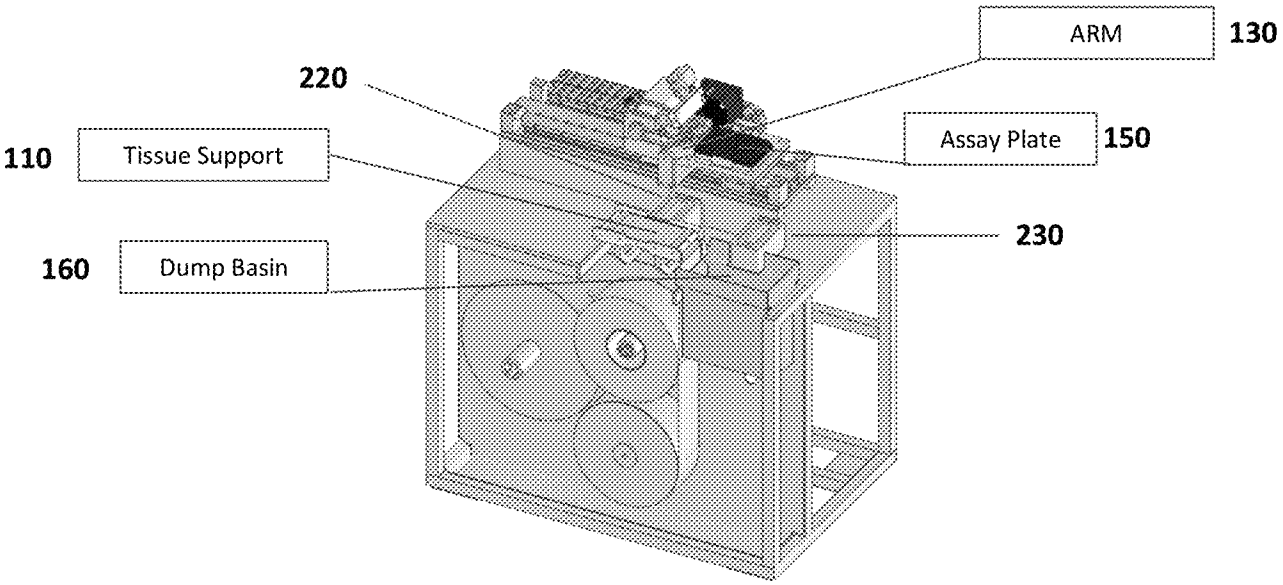
FIG. 5 is a second orthogonal view of a plate washing system according to an exemplary embodiment.
Figure 15:
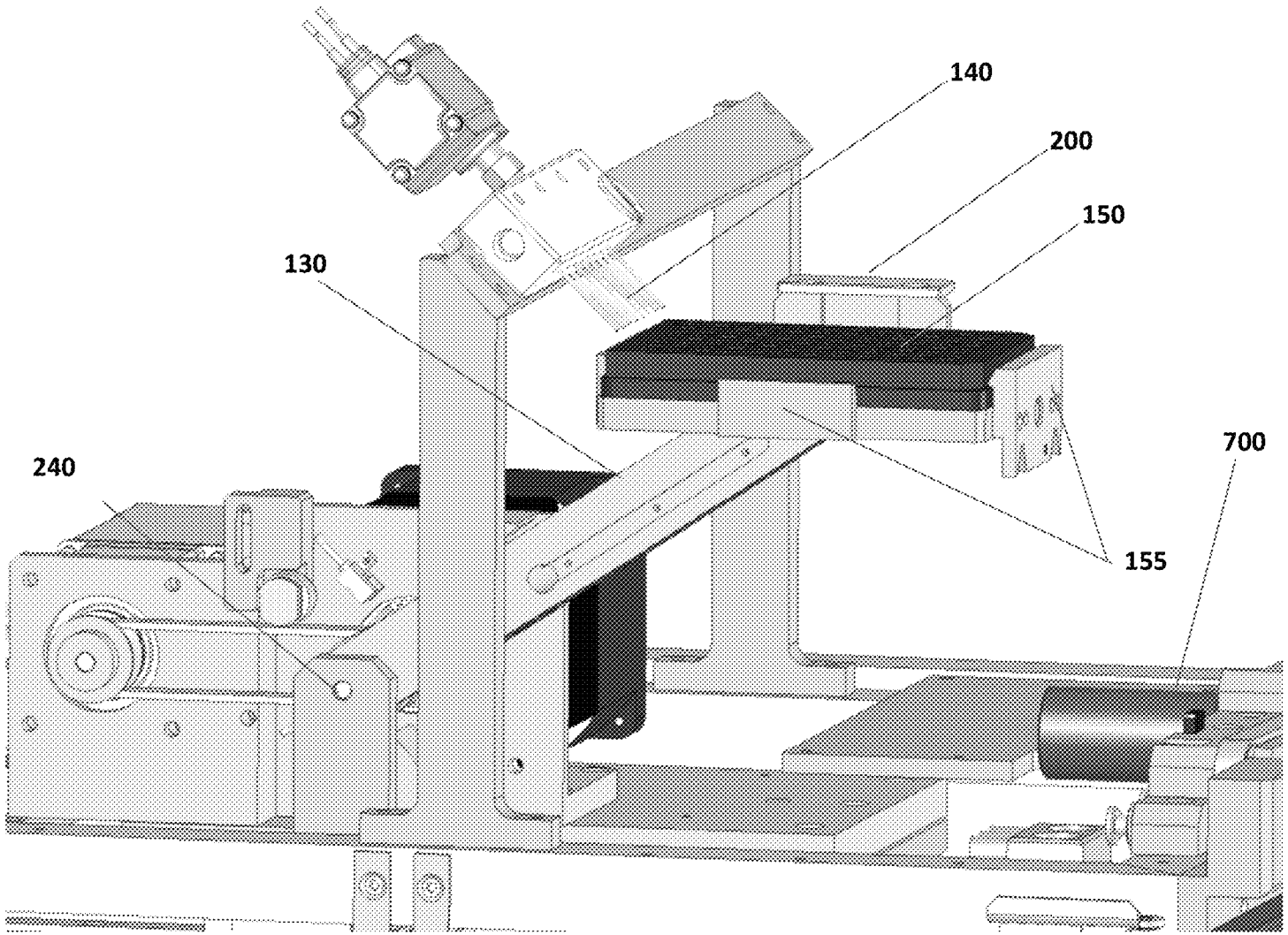
FIG. 15 is a perspective view of a plate washing system according to an exemplary embodiment.
Figure 16A:
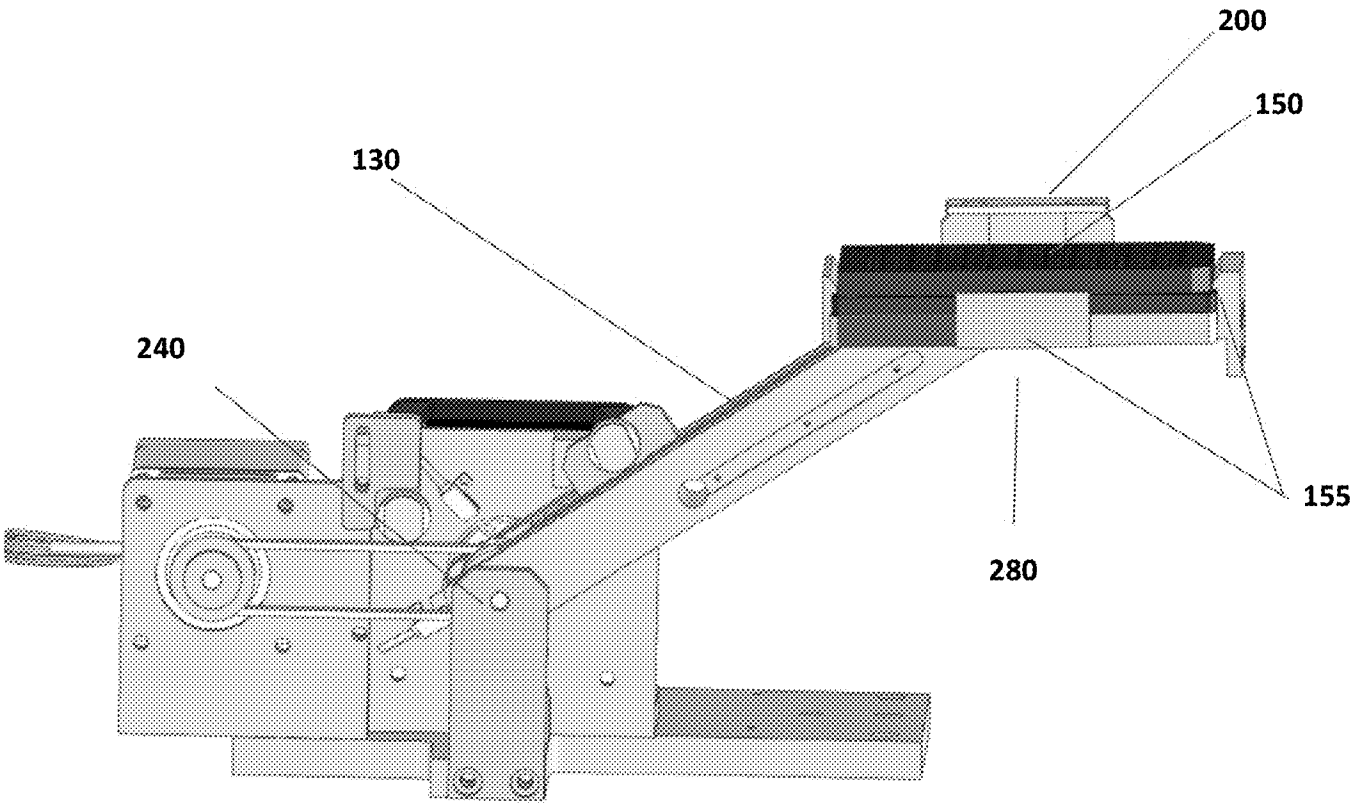
FIGS. 16A-16F show a perspective view of a plate washing system illustrating rotation of the arm assembly to expel liquid into the removal basin according to an exemplary embodiment.
Figure 16B:
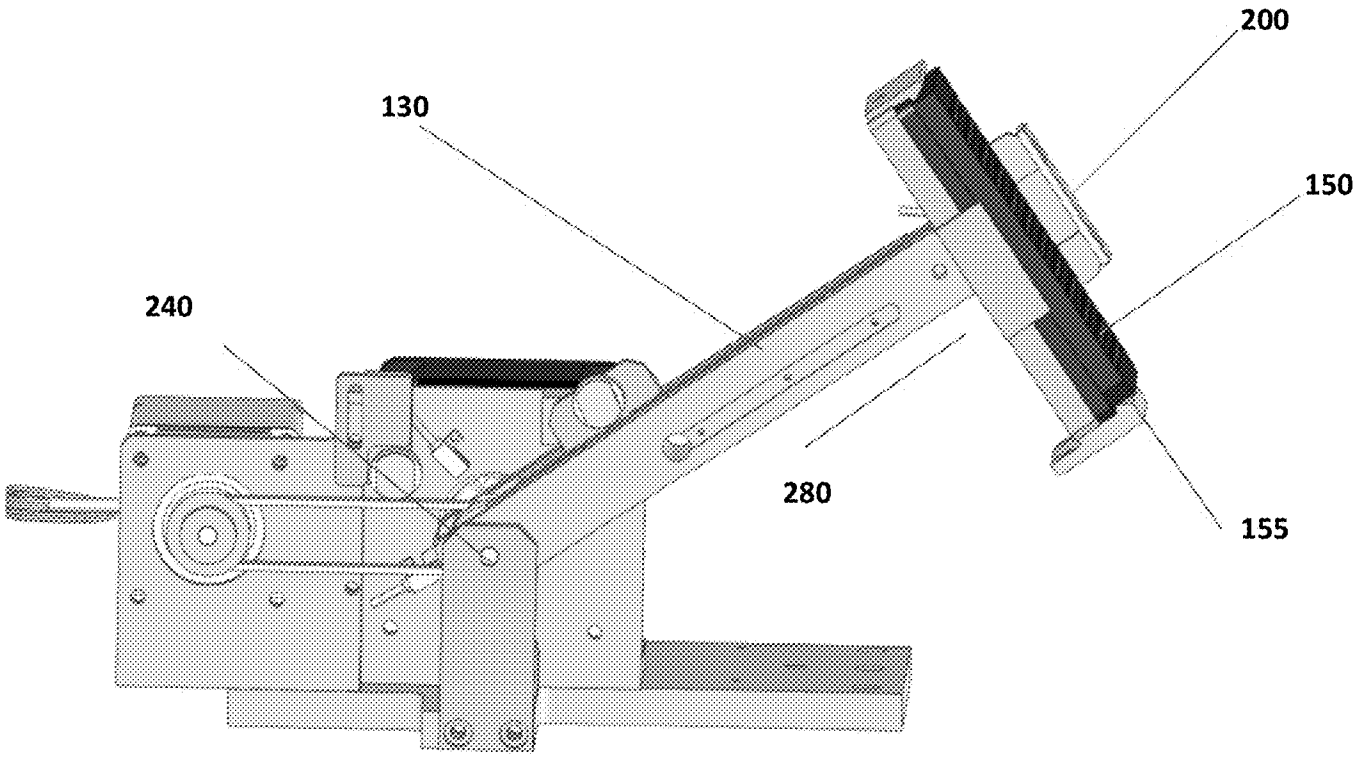
Figure 16C:
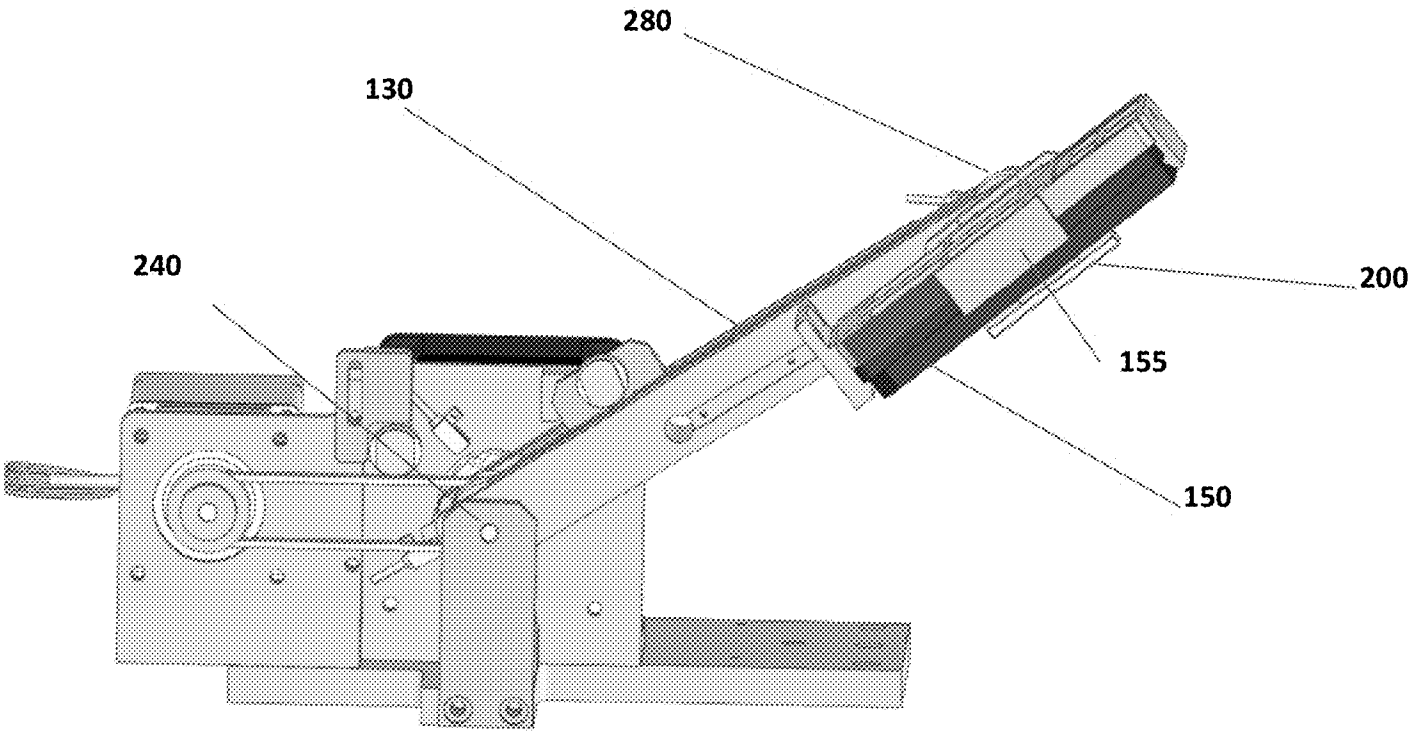
Figure 16D:
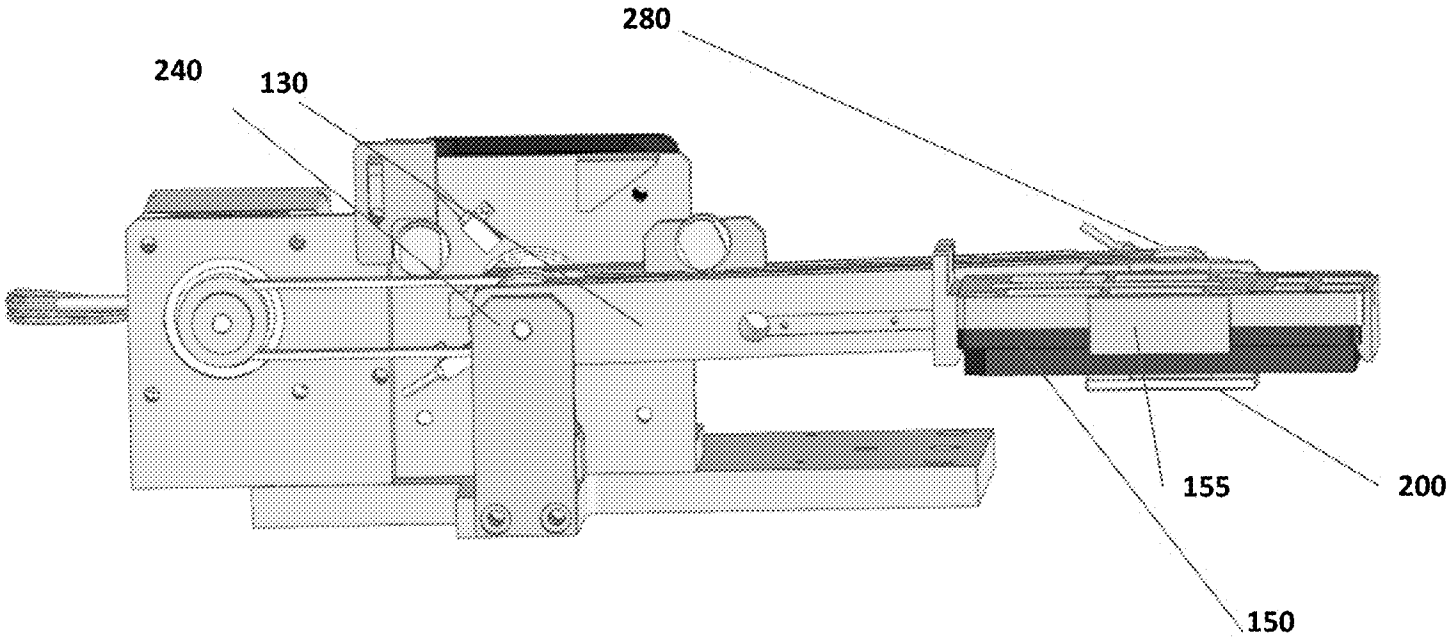
Figure 16E:
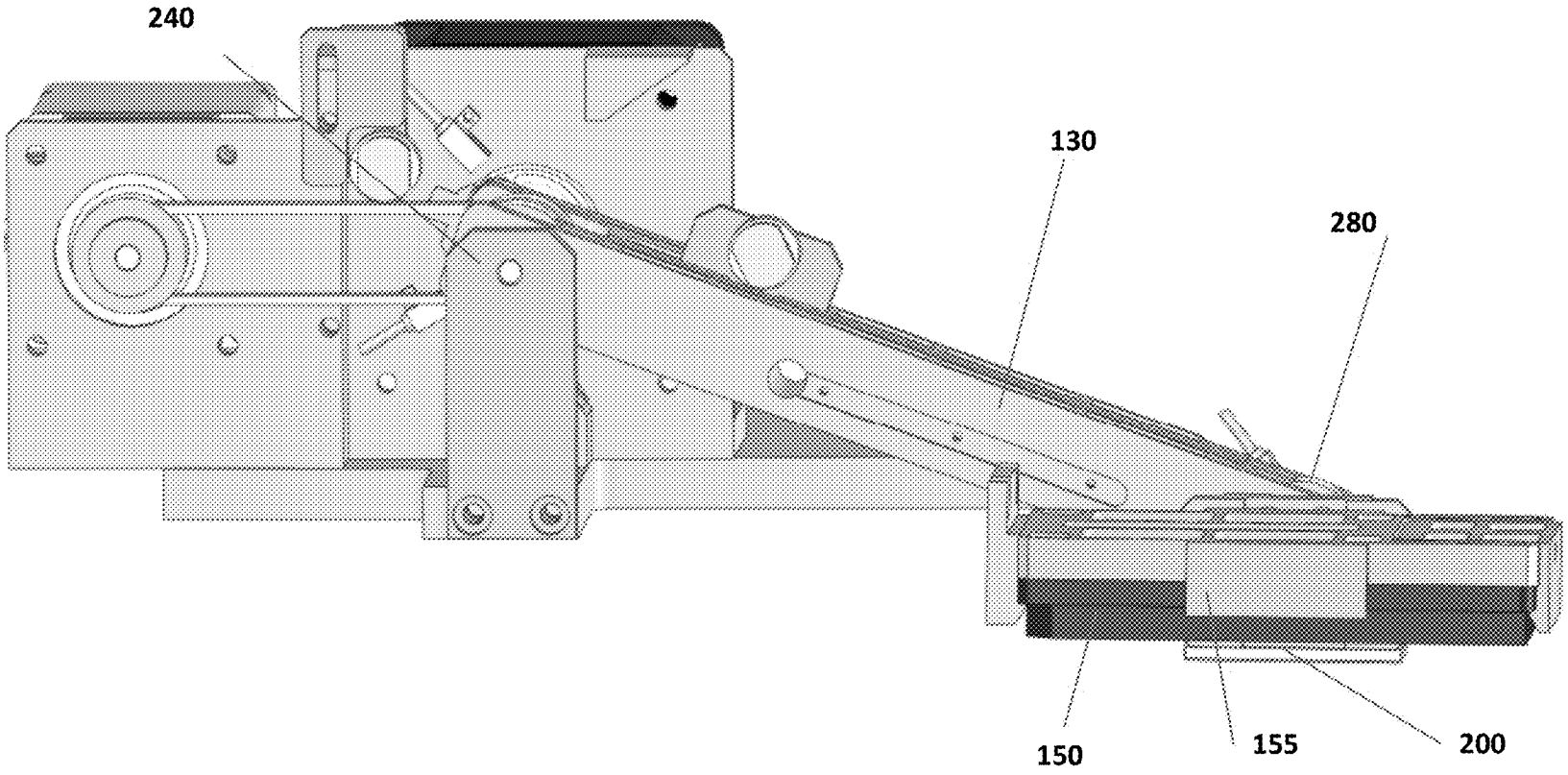
Figure 16F:
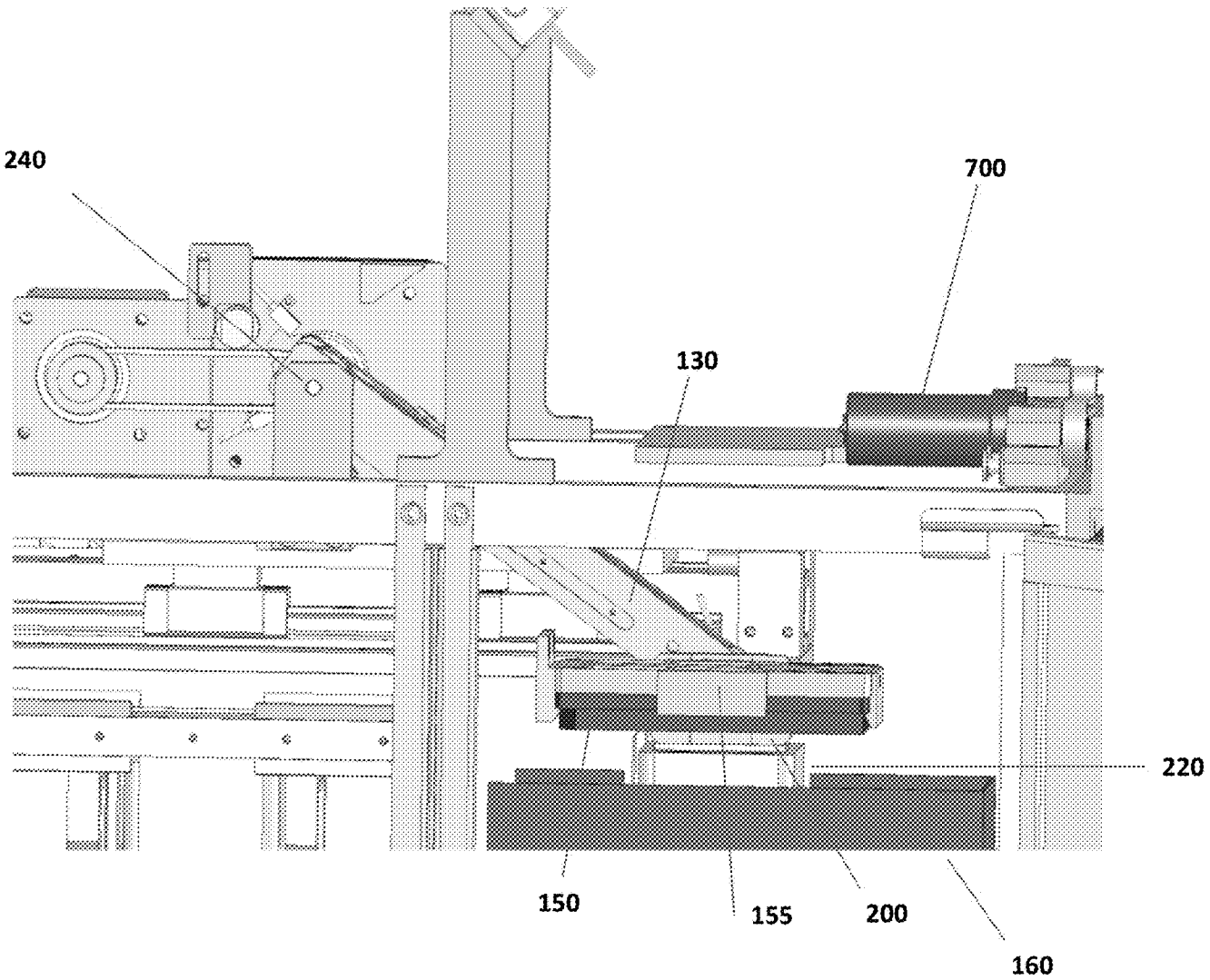
Figure 17A:
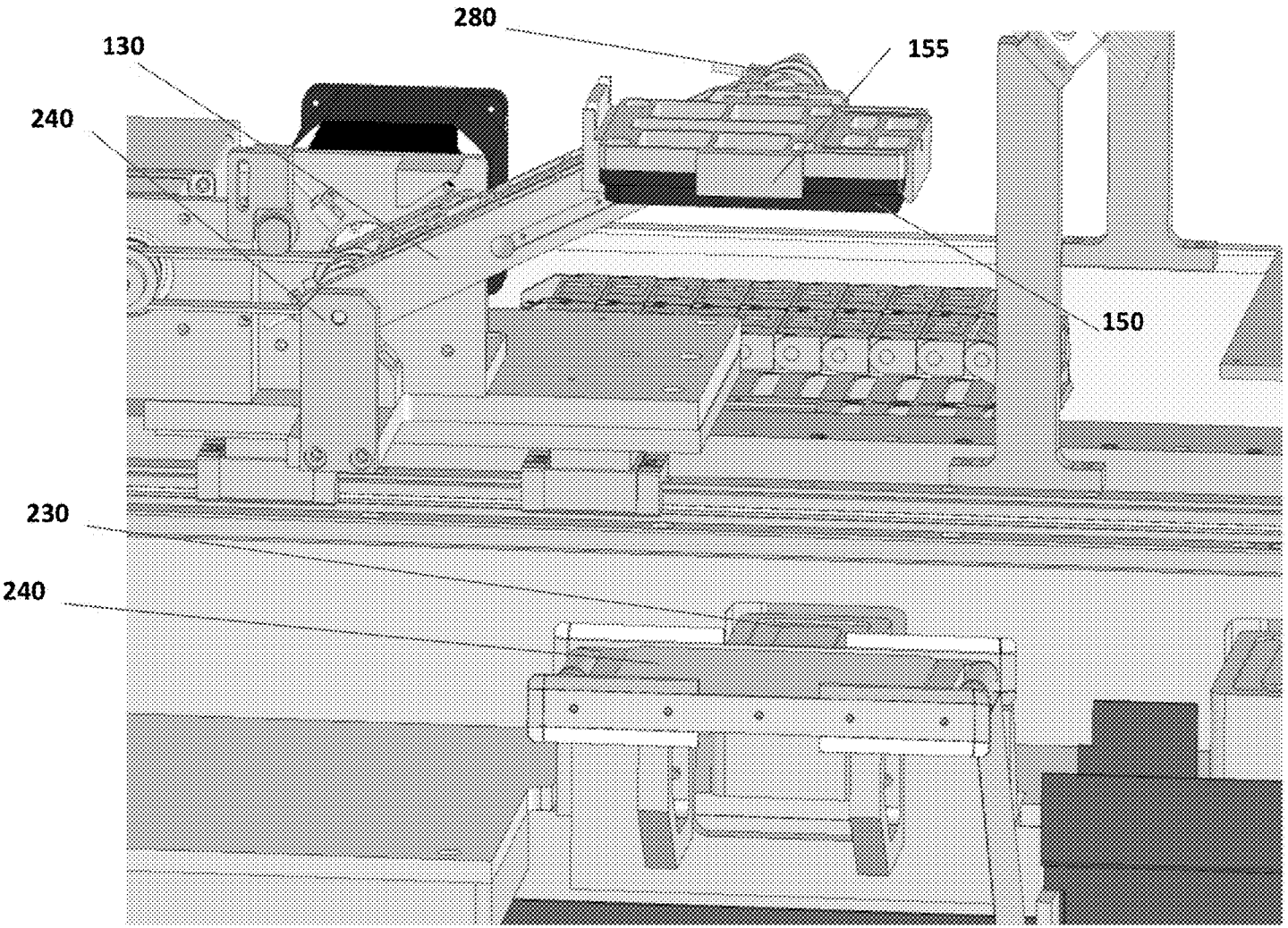
FIGS. 17A-17D show a perspective view of a plate washing system illustrating rotation of the arm assembly to expel liquid into the tissue support according to an exemplary embodiment.
Figure 17B:
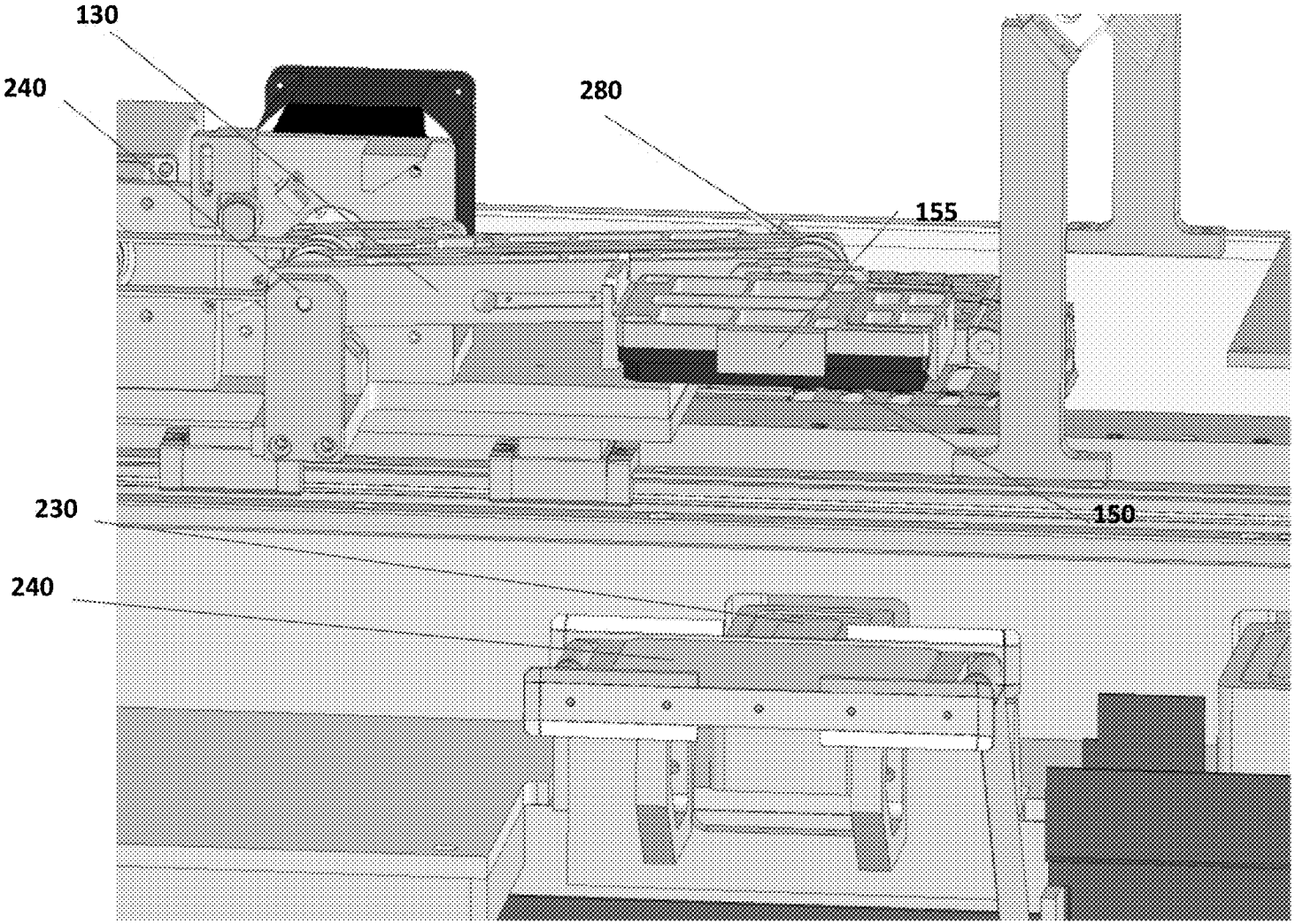
Figure 17C:
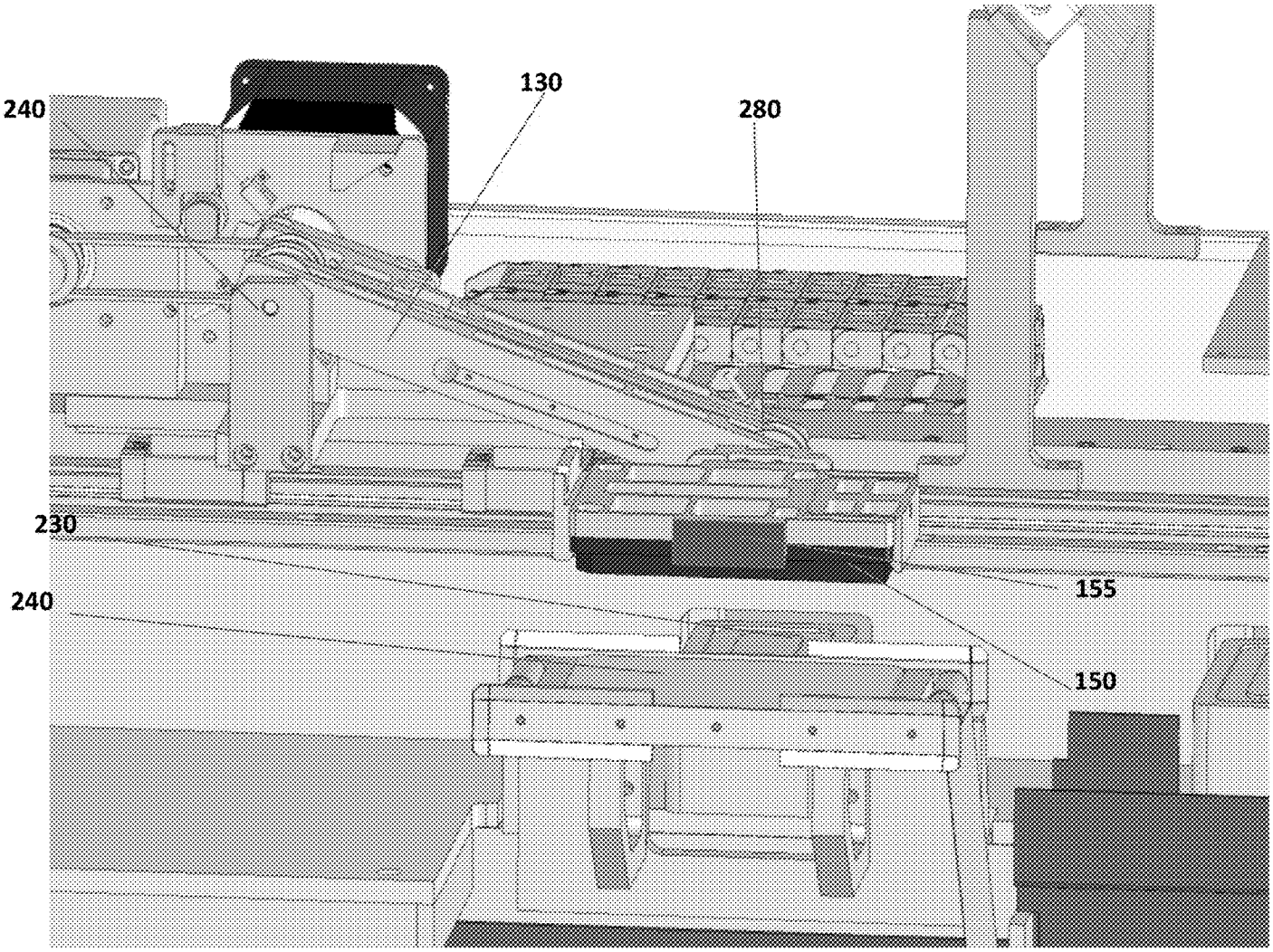
Figure 17D:
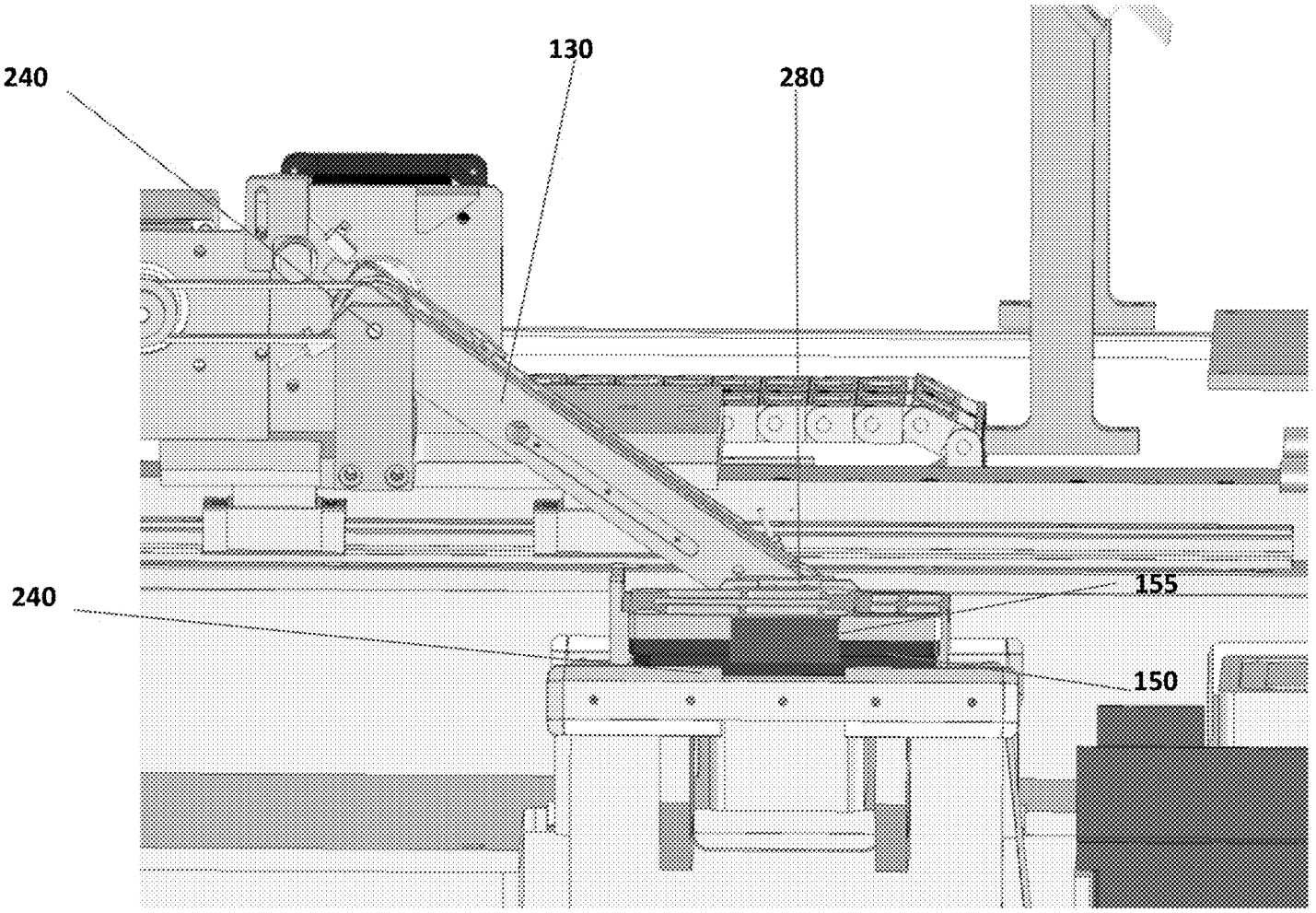

FIG. 1 shows a side view of a plate washing system according to an exemplary embodiment. FIG. 2 and FIG. 3 show a front view and top view, respectively, of a plate washing system according to an exemplary embodiments. FIG. 4 and FIG. 5 show orthogonal views of a plate washing system according to an exemplary embodiment. FIG. 15 is a perspective view of a plate washing system according to an exemplary embodiment. FIGS. 16A-16F show a perspective view of a plate washing system illustrating rotation of the arm assembly to expel liquid into the removal basin according to an exemplary embodiment. FIGS. 17A-17D show a perspective view of a plate washing system illustrating rotation of the arm assembly to expel liquid into the tissue support according to an exemplary embodiment. In some embodiments, as shown in FIG. 2 and FIG. 3, the plate washer 100 includes an electromagnetic circuit 210, including an electromagnet 220 for removal and an electromagnet 230 for drying, that moves and rotates the arm assembly 130 and impacts the assay plate 150 above the removal basin 160 and against the absorbent material, such as tissue on the support 110 to dispel residual fluid. The arm 130 holds the assay plate with a gripper 155. The electromagnet dump 220 and electromagnet dry 230 may, for example, be rectangular pucks or other shapes. To rotate the assay plate, a plate 200 is mounted on the arm assembly 130. In some embodiments, the plate 200 is a metal plate such as a steel plate. When the assay plate 150 is rotated by the arm 130 to dispose of fluid in the removal basin 160 or to position the assay plate above the absorbent material, the plate 200 rotates from an upward facing position to a downward facing position as illustrated in FIGS. 16A-16F and FIGS. 17A-17D. In some embodiments, the plate 200 may comprise one or more materials such as steel that are attracted to the electromagnet. The electromagnet dump 220 acts against the plate 200, creating the force that accelerates and impacts the plate 200 against the electromagnet dump 220, removing the residual fluid in the assay plate 150 into the removal basin 160, as illustrated in FIGS. 16A-16F. In some embodiments, the steel plate and/or another portion of the arm may impact against another structure to rapidly decelerate the arm and to expel the fluid from the assay. The arm assembly 130 then moves along linear axis 120 (as shown in FIG. 1) to position the assay plate 150 above the absorbent material in the support 110 with the assay plate 150 facing downward. The electromagnet dry 230 subsequently acts against the plate 200, creating the force that accelerates and impacts the assay plate 150 against the absorbent material in the support 110 to remove residual fluid from the assay plate 150, as illustrated in FIGS. 17A-17D. In some embodiments, the electromagnet dry 230 also acts against the plate 200, creating the force that accelerates and impacts the steel plate 200 against the electromagnet dump 220.

As shown in FIGS. 3, 15, 16A-6F, and 17A-17D, the arm assembly 130 includes a plate rotational axis 280 and arm rotational axis 240. The assay plate 150 rotates about the plate rotational axis 280 from an upward orientation where it may receive fluid from the fluid manifold 140 to a downward orientation where it may empty fluid into the removal basin 160 and be dried with the absorbent material, such as tissue. The arm assembly 130 moves between the removal basin 160 and the support 110 along the linear axis 120. The arm assembly 130 rotates about the arm rotational axis 240 to accelerate and remove the material in the assay plate 150 into the removal basin 160 and against the absorbent material in the support 110.

In some embodiments, the plate washing system includes a rotation servo (for the plate) 260 and a rotational servo (for the arm) 270. The rotation servo (for the plate) 260 rotates the assay plate 150 about the plate rotational axis 280. The rotation servo (for the plate) 260 rotates the assay plate 150 from an upward position to a downward position. The rotation servo (for the plate) 260 also rotates the assay plate 150 between other positions. The rotational servo (for the arm) 270 rotates the arm assembly 130 about the arm rotational axis 240.

In some embodiments, the rotational servo (for the arm) 270 is a hybrid servo that operates in a closed loop to rotate the arm assembly 130 and transitions to an open loop servo before the residual material in the assay plate 150 is removed into the removal basin 160 or before the assay plate 150 impacts the support 110. For example, to remove the residual material in the assay plate 150 into the removal basin 160, the rotational servo (for the arm) 270 begins as a closed loop servo that rotates the arm assembly 130 about the arm rotational axis 240. As the plate 200 of the arm assembly 130 gets closer to the electromagnet dump 220, the electromagnet dump 220 is activated and begins to pull the plate 200 toward the electromagnet dump 220. Before the plate 200 impacts the electromagnet dump 220, the rotational servo (arm) 270 becomes an open loop servo (e.g., by powering-off the rotational servo), which allows the arm to rotate freely. This allows the plate 200 to be accelerated towards the electromagnet dump 220 by the electromagnet dump 220, to impact the electromagnet dump 220, and to be held against the electromagnet dump 220. This in turn allows the arm to be accelerated toward the removal basin 160 and to dispel the fluid into the removal basin 160. Following impact, the electromagnet dump 220 is deactivated and the rotational servo (for the arm) 270 transitions back to a closed loop servo to rotate the arm assembly 130 to move the assay plate 150 away from the dump basin 160. In some embodiments, this process of accelerating and impacting the plate 200 against the electromagnet dump 220 to remove material in the assay plate 150 into the removal basin 160 using the rotational servo (arm) 270 and the electromagnet dump 220 may be repeated multiple times to increase the portion of the liquid that is removed into the removal basin. In some embodiments, this process is performed a single time. In other embodiments it is repeated two, three, or four times. In some embodiments, it is repeated more than twice. In some embodiments, it is repeated more than four times.

In some embodiments, to dry the assay plate 150 with the absorbent material in the support 110, the rotational servo (arm) 270 begins as a closed loop servo that rotates the arm assembly 130 about the arm rotational axis 240. As the plate 200 of the arm assembly 130 gets closer to the electromagnet (for drying) 230, the electromagnet dry 230 begins to pull the plate 200 toward the electromagnet (for drying) 230. Before the assay plate 150 impacts the absorbent material in the support 110, the rotational servo (arm) 270 becomes an open loop servo which allows the arm to rotate freely. This allows the plate 200 to be accelerated towards the electromagnet (for drying) 230, to impact the electromagnet (for drying) 230, and to be held against the electromagnet (for drying) 230. This in turn allows the arm to be accelerated toward the absorbent material in the support 110 and to dispel the fluid into the absorbent material. Advantageously, by transitioning from a closed loop servo to an open loop servo before impact, strain on the servo from impact of the assay plate 150 with the removal basin 160 or the absorbent material in the support 110 may be reduced. Following impact, the electromagnet (for drying) 230 is deactivated and the rotational servo (for the arm) 270 transitions back to a closed loop servo to rotate the arm assembly 130 to move the assay plate 150 away from the absorbent material in the support 110. In some embodiments, this process of accelerating and impacting the assay plate 150 against the absorbent material in the support 110 using the rotational servo (arm) 270 and the electromagnet dry 230 may be repeated multiple times to increase the portion of the liquid that is removed by the absorbent material. In some embodiments, this process is performed a single time. In other embodiments it is repeated two, three, or four times. In some embodiments, it is repeated more than twice. In some embodiments, it is repeated more than four times.

In an exemplary embodiment, the electromagnets and servos may be controlled through a hardware and/or software controller. The controller may control the timing when the electromagnet (for removal) 220 and the electromagnet (for drying) 230 activate and deactivate and when the rotational servo (arm) 270 transitions from a closed loop servo to an open loop servo and back to a closed loop servo. In some embodiments, the controller is implemented by one or more processors executing a computer program to perform functions by operating on input data and/or generating output data. One or more of the modules can be implemented in hardware using an ASIC (application-specific integrated circuit), PLA (programmable logic array), DSP (digital signal processor), FPGA (field programmable gate array), or other integrated circuit. In some embodiments, two or more modules can be implemented on the same integrated circuit, such as ASIC, PLA, DSP, or FPGA, thereby forming a system on chip. Subroutines can refer to portions of the computer program and/or the processor/special circuitry that implement one or more functions. In some embodiments, the controller is implemented in digital and/or analog electronic circuitry, or in computer hardware, firmware, software, or in combinations of them. In some embodiments, the implementation is as a computer program product, e.g., a computer program tangibly embodied in a machine-readable storage device, for execution by, or to control the operation of, a data processing apparatus, e.g., a programmable processor, a computer, and/or multiple computers. A computer program can be written in any form of computer or programming language, including source code, compiled code, interpreted code and/or machine code, and the computer program can be deployed in any form, including as a stand-alone program or as a subroutine, element, or other unit suitable for use in a computing environment. A computer program can be deployed to be executed on one computer or on multiple computers at one or more sites.

In some embodiments, the arm assembly 130 may be positioned between 15 and 30 degrees above a horizontal plane and rotate to between 20 and 40 degrees below the horizontal plane where the plate 200 impacts the electromagnet (for removal) 220 or electromagnet (for drying) 230, causing the assay plate 150 to dispel the fluid into the removal basin 160 or the support 110. In some embodiments, the arm assembly 130 may be positioned 20 degrees above the horizontal plane and rotate to 30 degrees below the horizontal plane where the plate 200 impacts the electromagnet (for removal) 220 or electromagnet (for drying) 230, causing the assay plate 150 to dispel the fluid into the removal basin 160 or the support 110. In some embodiments, the plate 200 may be secured with fasteners including but not limited to steel screws, nuts and bolts, and other suitable fasteners to a plate holder for holding the plate 200. In some embodiments, the rotation above the horizontal plane is greater than 30 degrees or less than 15 degrees. In some embodiments, the rotation below the horizontal plane is greater than 40 degrees or less than 20 degrees.

In some embodiments, the arm rotational servo 270 (as shown in FIG. 3) accelerates the arm assembly 130 from a starting position above the horizontal plane for between 100 and 140 milliseconds, at which time the arm rotational servo 270 becomes open loop and electromagnet (220 or 230) is activated. The arm assembly 130 is pulled by the electromagnet (220 or 230) and continues its rotation for another 20 to 40 milliseconds, at which time it is stopped against the top of the electromagnet (220 or 230), and expels the contents of the plate into the removal basin or the absorbent material). In some embodiments, the arm rotational servo 270 accelerates the arm assembly 130 for 118 milliseconds and then transitions to open loop, at which point the electromagnet (220 or 230) is activated and pulls the arm assembly 130 for another 30 milliseconds until impact with the electromagnet (220 or 230). Following impact, the arm rotational servo 270 closes for between 500 to 600 milliseconds and returns the arm assembly 130 to the starting position. In some embodiments, the servo closes for 560 milliseconds to return the arm assembly 130 to the starting position. The timing sequence described herein is intended to be exemplary. In some embodiments, the servos may be opened or closed for longer or shorter periods of time than the examples described. Likewise, in some embodiments, the electromagnet may be active for longer or shorter periods of time than described herein. In the embodiments described herein, the electromagnet activates after the servo opens. In other embodiments, the electromagnet activates while the servo is still closed.

In some embodiments, as shown in FIG. 1, the plate washer 100 includes floor mounts 190 with retractable wheels. The retractable wheels (not depicted) maybe be extended and retracted with an activation mechanism such as a lever or other control. In some embodiments, the plate washing system includes two removable source wheel 180 for providing clean absorbent material, such as clean tissue, and one take-up wheel 170 for taking up used absorbent material, for example, tissue that has already absorbed the residual fluid from the plate. In other words, source wheel 180 feeds absorbent material such as tissue up to the support 110, and the take-up wheel receives the used absorbent material and feeds it away from the plate washer. In some embodiments, the plate washing system includes fewer or additional wheels. In some embodiments, the support 110 is located above the source wheels 180. In some embodiments, the plate washing system moves the absorbent material vertically up the source wheels 180 and over the support 110 and back down into the take-up wheel 170. Assay plates 150 are dried against the absorbent material on the support 110. The bulk of the wash material may be removed from the plate and into a removal basin 160, where it passes through a tube 195 from the bottom of the removal basin 160 and into a container, such as a carboy, stored underneath. The dump basin 160, take-up wheel 170, and support 110 can be removed for sterilization. Fluid can be dispensed to a well assay plate via a fluid manifold 140. The well assay plates can be maneuvered by an arm assembly 130 along a linear axis 120, allowing movement of the assay plate 150 underneath the fluid manifold 140.

In some embodiments, four wash cycles each of dispensing fluid via a manifold and removing fluid by impacting the plate is completed in under 100 seconds. In some embodiments, four wash cycles are completed in under 93 seconds. In further embodiments, four wash cycles are completed in under 120 seconds. In some embodiments, four complete wash cycles are completed in longer than 120 seconds and in some embodiments, other numbers of wash cycles are performed.

Figure 14A:
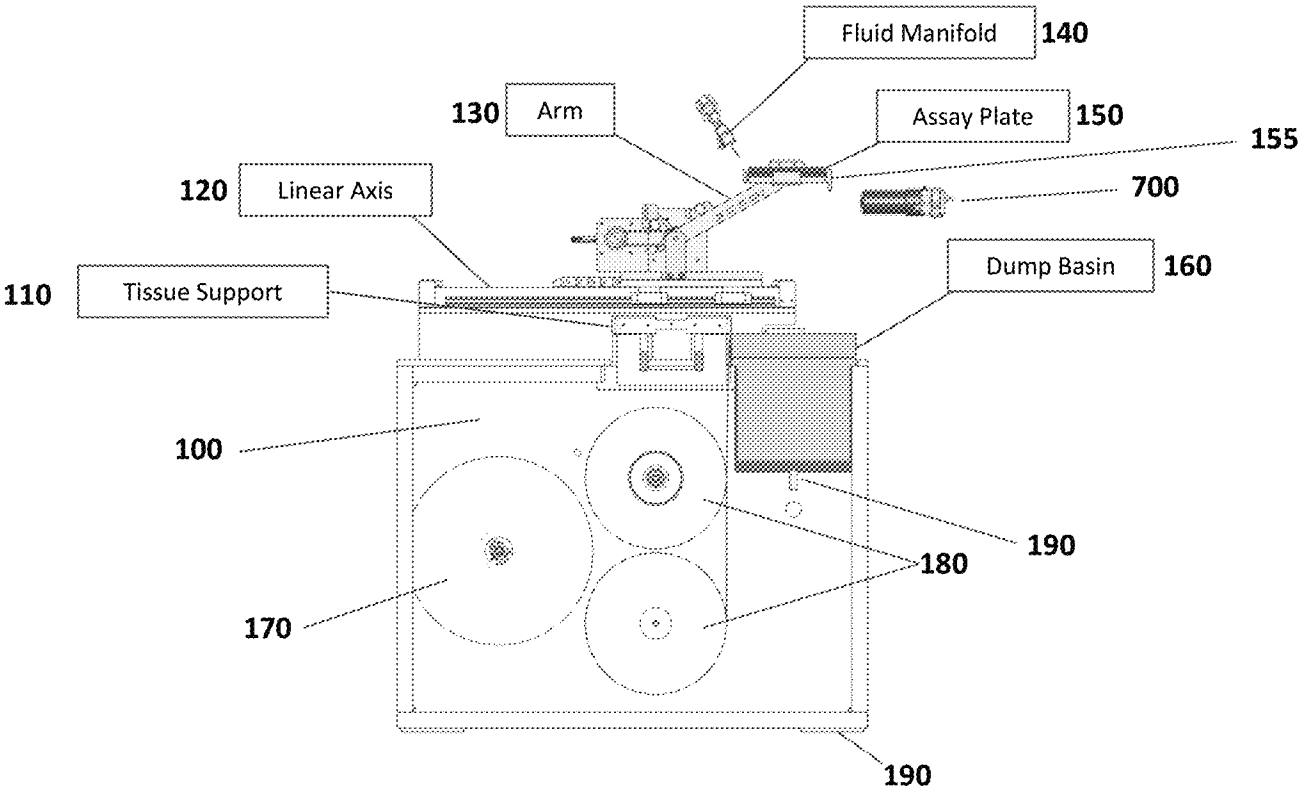
FIG. 14A is a side view of one embodiment of a plate washing system that includes a docking station for loading, unloading, and positioning the multiwell plate in the arm assembly according to an exemplary embodiment.
Figure 14B:
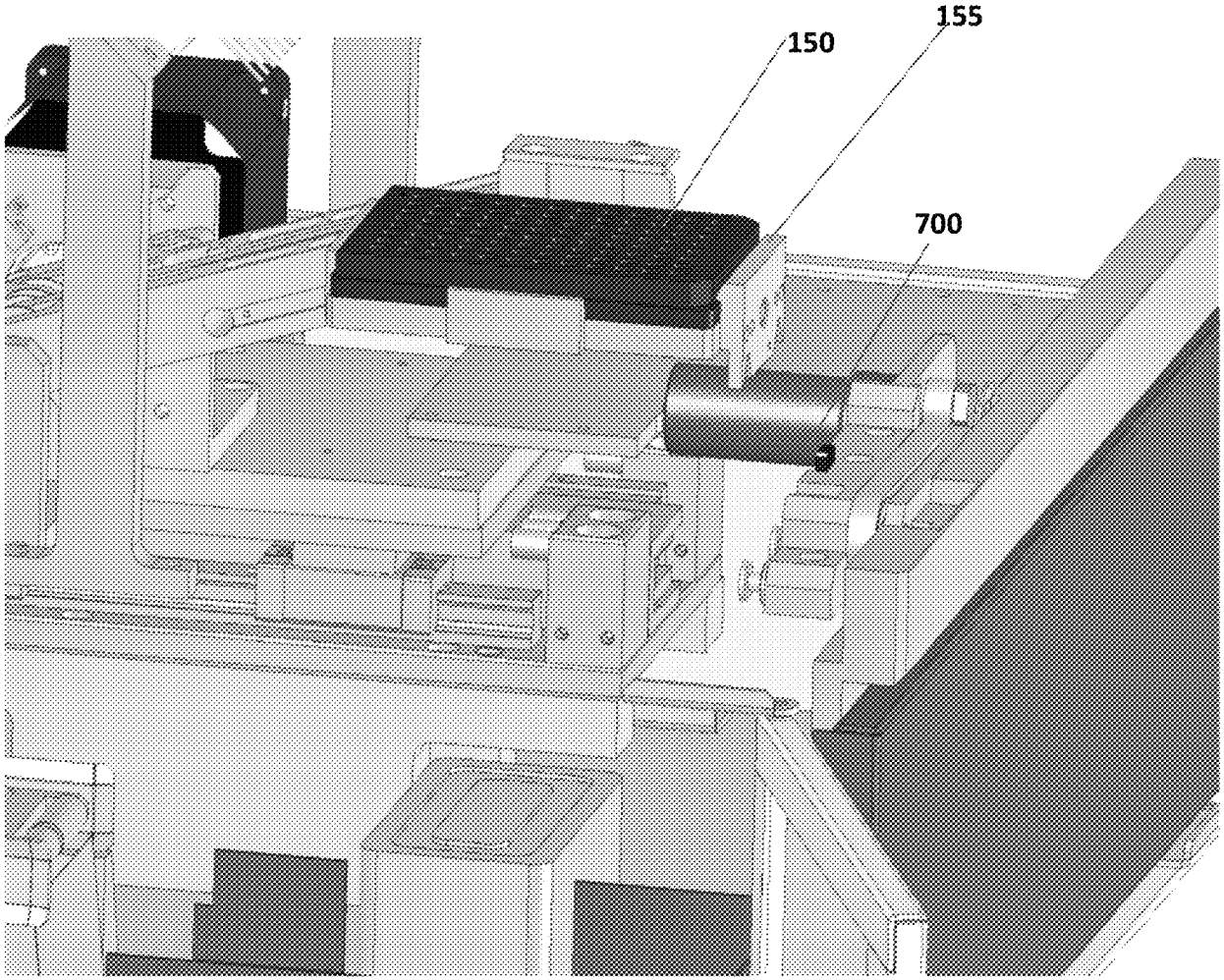
FIGS. 14B-14E show a perspective view of a plate washing system that includes a docking station for loading, unloading, and positioning the multiwell plate in the arm assembly according to an exemplary embodiment.
Figure 14C:
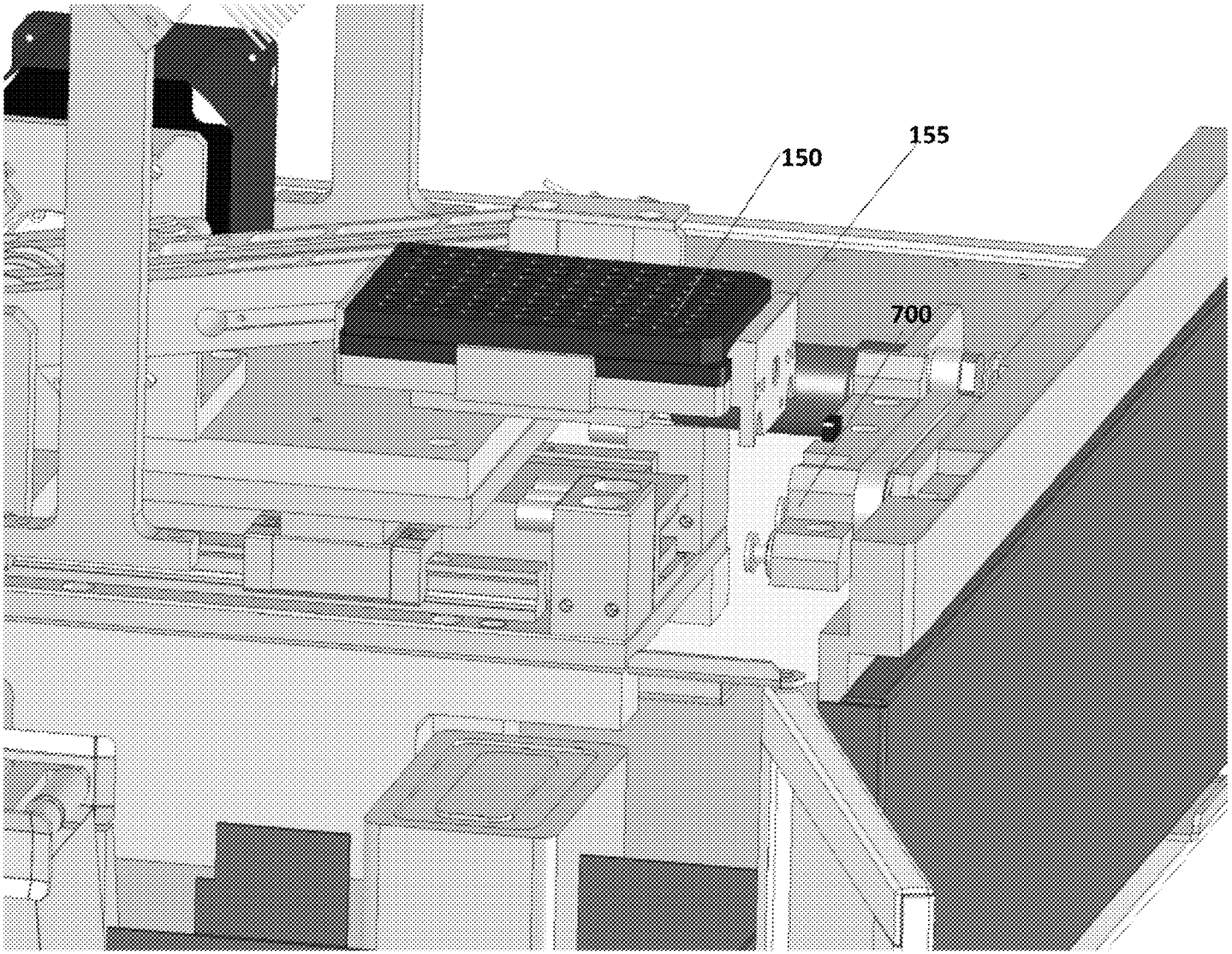
Figure 14D:
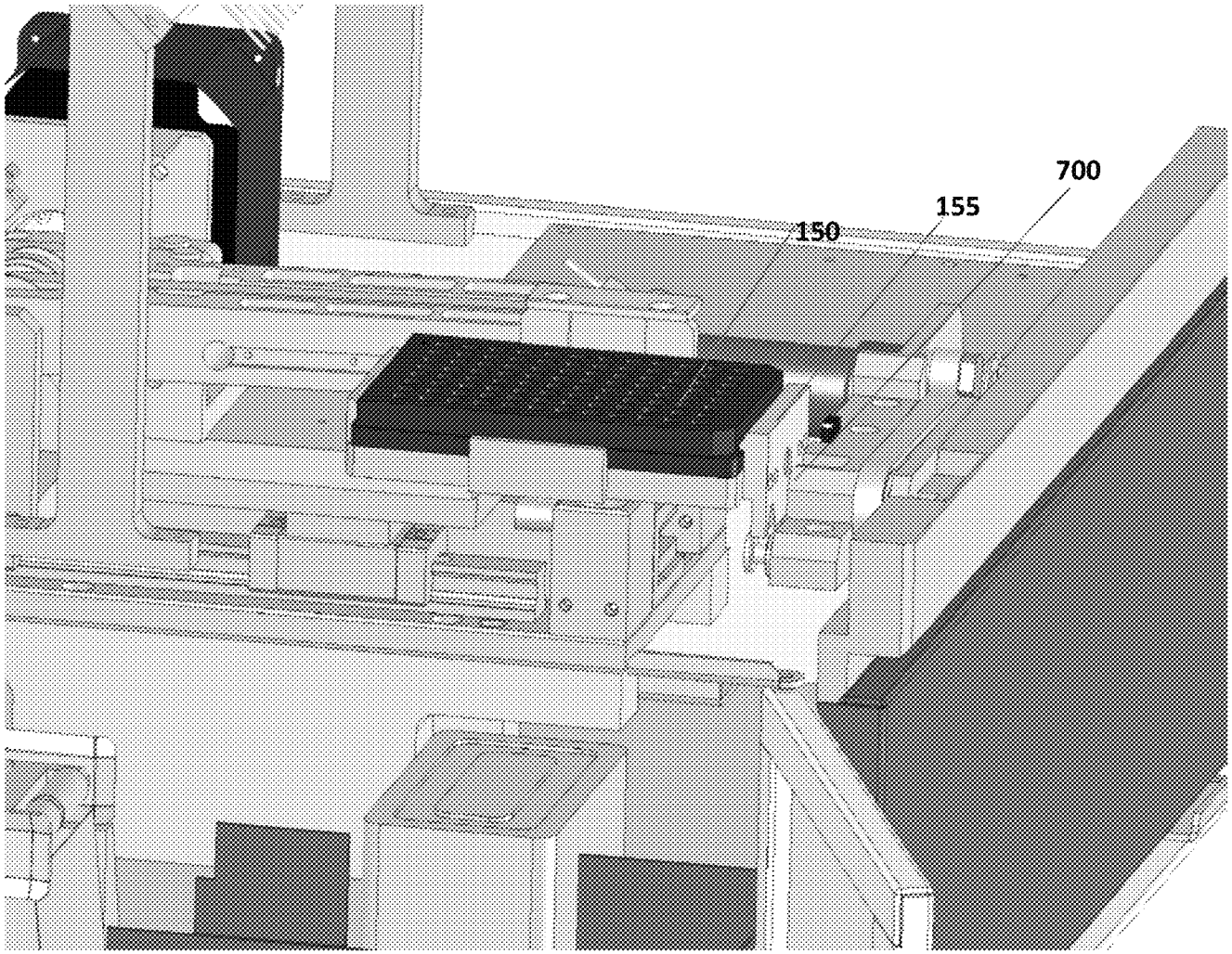
Figure 14E:
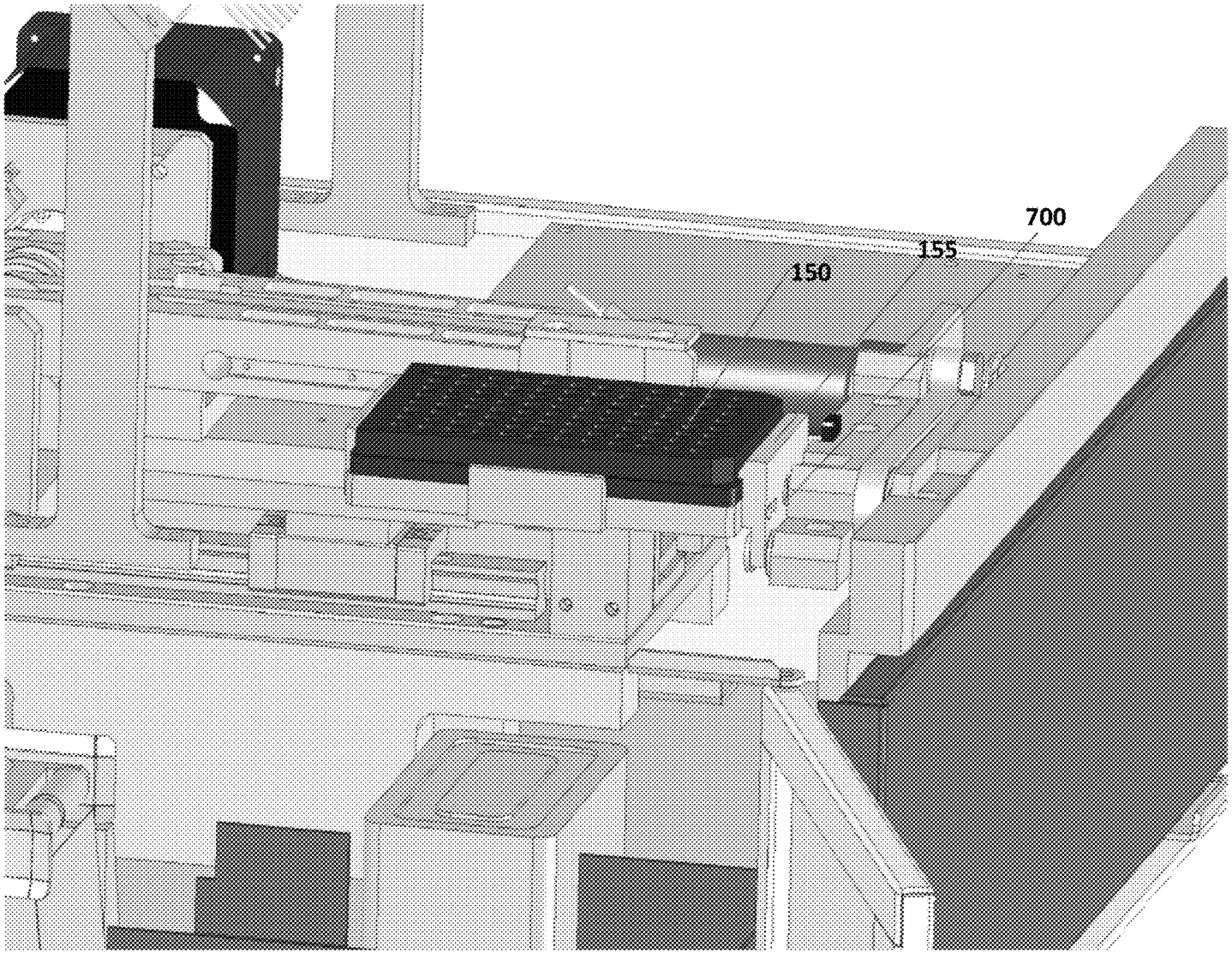

FIG. 14A depicts an exemplary embodiment that includes a docking station 700. FIGS. 14B-14E show a perspective view of a plate washing system that includes a docking station for loading, unloading, and positioning the multiwell plate in the arm assembly according to an exemplary embodiment. In some embodiments, a docking station is used for loading, unloading, and positioning the multiwell plate in the gripper 155 on the arm assembly 130. The arm 130 lowers the multi well plate 150 and gripper 155 onto the docking station 700 as shown in FIGS. 14B-14E. The docking station 700 senses the gripper 155 and an actuator opens the gripper 155 so that the multi well plate 150 can be removed. When gripper 155 is open a multi well plate door latch unlocks allowing access for loading.

The following examples illustrate some preferred modes of practicing the present disclosure, but are not intended to limit the scope of the claimed invention. Alternative materials and methods may be used to obtain similar results.

EXAMPLE 1

Performing an ELISA Assay

Figure 11:
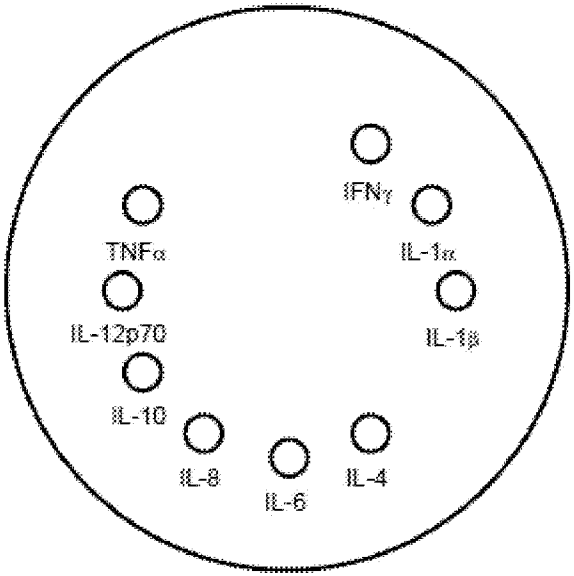
FIG. 11 illustrates exemplary antibody samples printed onto a well of an assay plate.

The Ciraplex® immunoassay kit is a multiplex sandwich ELISA (Enzyme-Linked ImmunoSorbent Assay) for the quantitative measurement of target proteins in serum, EDTA/heparin/sodium citrate-recovered plasma, and tissue culture supernatants. According to the immunoassay kit, each well of a 96-well microplate was pre-spotted with protein-specific antibodies and these antibodies, as depicted in FIG. 11, capture specific proteins from the Standards, and samples of interest. After unbound protein was washed way, biotinylated detecting antibodies was added, which bound to a secondary site on the target proteins. After the removal of excess detection antibody, streptavidin-horseradish peroxidase (SA-HRP) was added. HRP is an enzyme that reacts with a substrate to produce a luminescent signal that is detected by the Circascan™ Imaging System. The intensity of the signal produced was directly proportional to the quantity of each protein in the Standard or sample of interest. The standard curve concentrations used are show in Table 1 below.

TABLE 1

| Standard Curve Concentrations | | | | | | | | | |
|---|---|---|---|---|---|---|---|---|---|
| | IFNγ pg/ml | IL-1α pg/ml | IL-1β pg/ml | IL-4 pg/ml | IL-6 pg/ml | IL-8 pg/ml | IL-10 pg/ml | IL-12p70 (heterodimer) pg/ml | TNFα (Active Trimer) pg/ml |
| Standard 1 | 50 | 1800 | 200 | 200 | 114 | 400 | 200 | 1200 | 400 |
| Standard 2 | 12.5 | 450 | 50 | 50 | 28.5 | 100 | 50 | 300 | 100 |
| Standard 3 | 3.125 | 112.5 | 12.5 | 12.5 | 7.125 | 25 | 12.5 | 75 | 25 |
| Standard 4 | 0.781 | 28.125 | 3.125 | 3.125 | 1.781 | 6.25 | 3.125 | 18.75 | 6.25 |
| Standard 5 | 0.195 | 7.031 | 0.781 | 0.781 | 0.445 | 1.562 | 0.781 | 4.688 | 1.562 |
| Standard 6 | 0.049 | 1.758 | 0.195 | 0.195 | 0.111 | 0.391 | 0.195 | 1.172 | 0.391 |

TABLE 1-continued

| Standard Curve Concentrations | | | | | | | | | |
|---|---|---|---|---|---|---|---|---|---|
| | IFNγ pg/ml | IL-1α pg/ml | IL-1β pg/ml | IL-4 pg/ml | IL-6 pg/ml | IL-8 pg/ml | IL-10 pg/ml | IL-12p70 (heterodimer) pg/ml | TNFα (Active Trimer) pg/ml |
| Standard 7 | 0.012 | 0.439 | 0.049 | 0.049 | 0.028 | Not Used for Curve | 0.049 | 0.293 | Not Used for Curve |
| Standard 8 | 0 | 0 | 0 | 0 | 0 | 0 | 0 | 0 | 0 |

Materials and Methods

Reagent Preparation—Wash Buffer

The 25X Wash Buffer was diluted to a 1X concentration using deionized (DI) water and stored at room temperature (20-25° C.).

Reagent Preparation—Recombination Standards

Each vial of lyophilized Standard was reconstituted with the volume of Sample Diluent as indicated in Table 3 below.

TABLE 3

| Lot Specific Reconstitution Volumes for Standards | |
|---|---|
| Analyte | Reconstitution Volume (μL) |
| IFNγ | 823 |
| IL-1α | 601 |
| IL-1β | 714 |
| IL-4 | 617 |
| IL-6 | 835 |
| IL-8 | 1101 |
| IL-10 | 750 |
| IL-12p70 (heterodimer) | 354 |
| TNFα (Active Trimer) | 513 |

Figure 10:
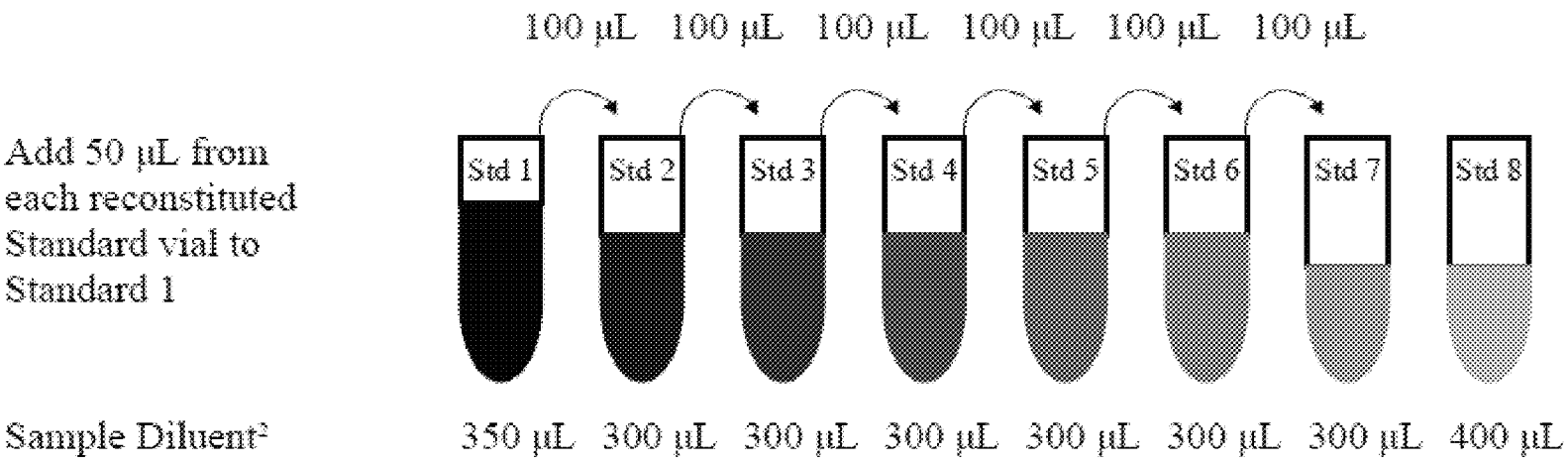
FIG. 10 illustrates exemplary serial dilutions of calibration standards used for conducting a biochemical assay.

After standing for 15 minutes, the Standard was inverted or gently vortexed to mix completely and used within one hour of reconstitution. As illustrated in FIG. 10, eight Standard tubes were prepared as follows: 350 μL of Sample Diluent into the Standard 1 tube, 300 μL into Standard tubes 2-7 and 400 μL into Standard 8 tube. 50 μL from each vial of reconstituted standard was pipetted into the Standard 1 tube. For serial dilutions, 100 μL of Standard 1 was added to Standard 2, 100 μL of Standard 2 was added to Standard 3, 100 μL of Standard 3 was added to Standard 4, 100 μL of Standard 4 was added to Standard 5, 100 μL of Standard 5 was added to Standard 6, 100 μL of Standard 6 was added to Standard 7, and 100 μL of Standard 7 was added to Standard 8. No protein was added to Standard 8 (the 0 pg/mL standard). Table 4 below shows the serial dilution of standards.

TABLE 4

| Serial Dilutions of Standards | | | | |
|---|---|---|---|---|
| Tube | Sample Diluent[2] | Standard | Serial Dilution | Final Dilution |
| Standard 1 | 350 μL | 50 μL from each reconstituted Standard vial | 1:1 | 1:1 |
| Standard 2 | 300 μL | 100 μL of Standard 1 | 1:4 | 1:4 |
| Standard 3 | 300 μL | 100 μL of Standard 2 | 1:4 | 1:16 |
| Standard 4 | 300 μL | 100 μL of Standard 3 | 1:4 | 1:64 |
| Standard 5 | 300 μL | 100 μL of Standard 4 | 1:4 | 1:256 |
| Standard 6 | 300 μL | 100 μL of Standard 5 | 1:4 | 1:1024 |

TABLE 4-continued

| Serial Dilutions of Standards | | | | |
|---|---|---|---|---|
| Tube | Sample Diluent[2] | Standard | Serial Dilution | Final Dilution |
| Standard 7 | 300 μL | 100 μL of Standard 6 | 1:4 | 1:4096 |
| Standard 8 | 400 μL | N/A | 1:0 | 1:0 |

MicroClime® Lid Preparation

To prevent edge effects and improve well-to-well consistency during assay processing, MicroClime® lids are used in place of traditional plate seals.

Before adding the standards and diluted samples to the pre-coated plate, the MicroClime® lid was removed from the packing material and positioned so that the filling trough (i.e. the groove around the margin of the lid) and corners are face up. 4 ml of deionized or distilled water was carefully dispensed into the filling trough on the top of the long edge of the lid. This procedure was repeated for the filling trough on the bottom of the long edge of the lid so that a total of 8 ml was added to the lid. Excess water from the filling troughs was removed with a lint-free lab wiper and the filled lid was placed on top of the assay plate.

Assay Procedure

Thawed samples were mixed by gently inverting the tube or vortexing. A plate layout similar to the template provided in FIG. 13 was used to plate the standards and samples. Assay wells were washed using a manual removal process with 300 uL of wash buffer four times and patted dry on absorbent tissue paper. 50 μL of the diluted Standard or diluted sample was added into each well. The filled assay plate was covered with a filled MicroClime® lid and incubated for two hours at room temperature (20-25° C.) on a shaker set to 450 rpm (Lab-Line 4625). Following incubation, reagent and samples were dumped and the plate washed 4 times with 300 μL 1× Wash Buffer. 50 μL of Biotinylated Antibody Reagent to each well, the plate covered again with a filled MicroClime® lid, and incubated 30 minutes at room temperature (20-25° C.) on the recommended shaker. After washing the plate four times, 50 μL of Streptavidin-HRP Reagent was added to each well, covered with a filled MicroClime® lid, and incubate for 30 minutes at room temperature (20-25° C.) on the recommended shaker. The plate was washed 4 times with 300 μL 1× Wash Buffer. Finally, 50 μL of SUPERSIGNAL Substrate was added to each well and the luminescence within 2 to 4 minutes on a Circascan™ Imaging System. The procedures above are summarized in FIG. 12.

Results

Figure 6:
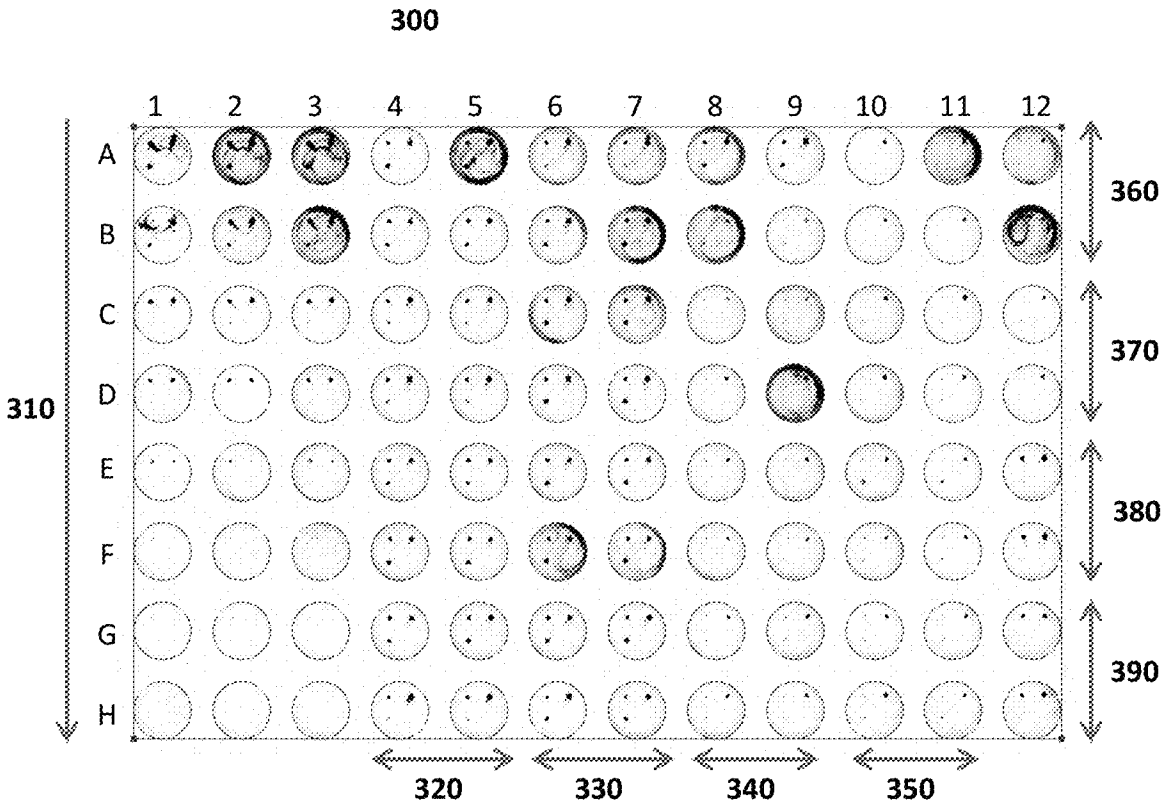
FIG. 6 shows multiwell plates with residual material after washing using other techniques.
Figure 7:
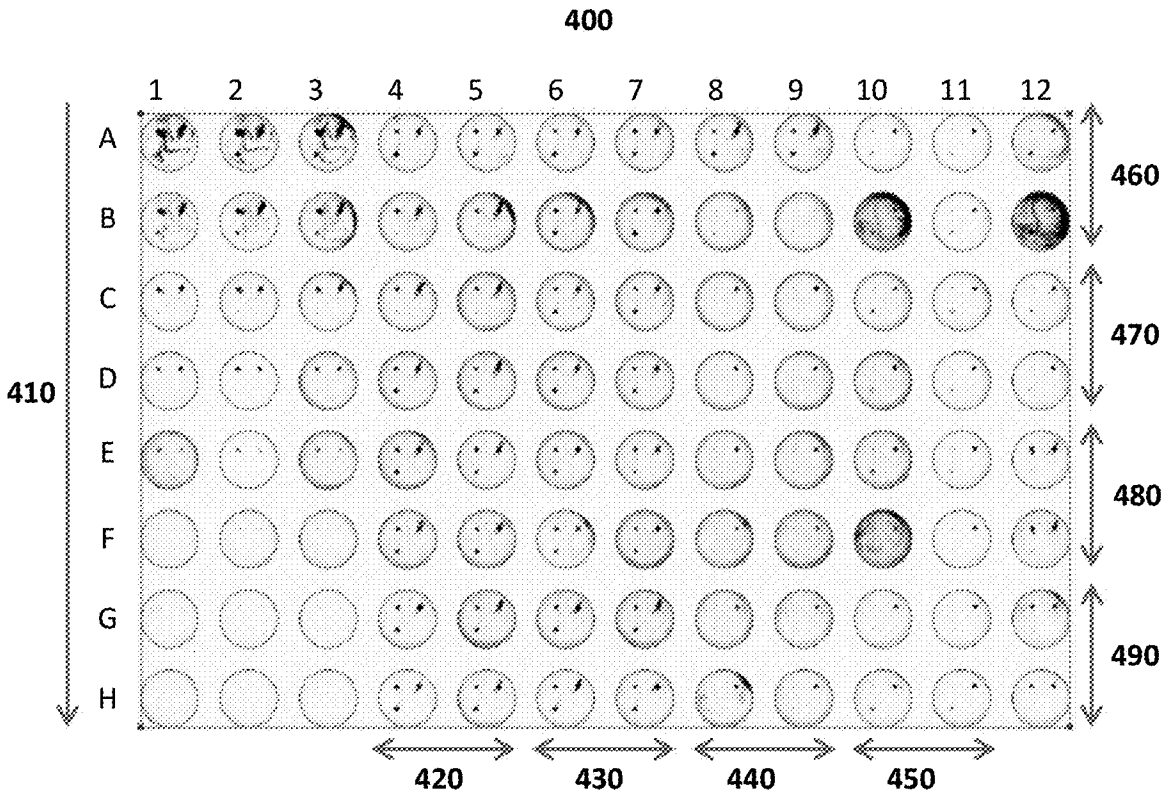
FIG. 7 shows additional multiwell plates with residual material after plate washing using other techniques.
Figure 8:
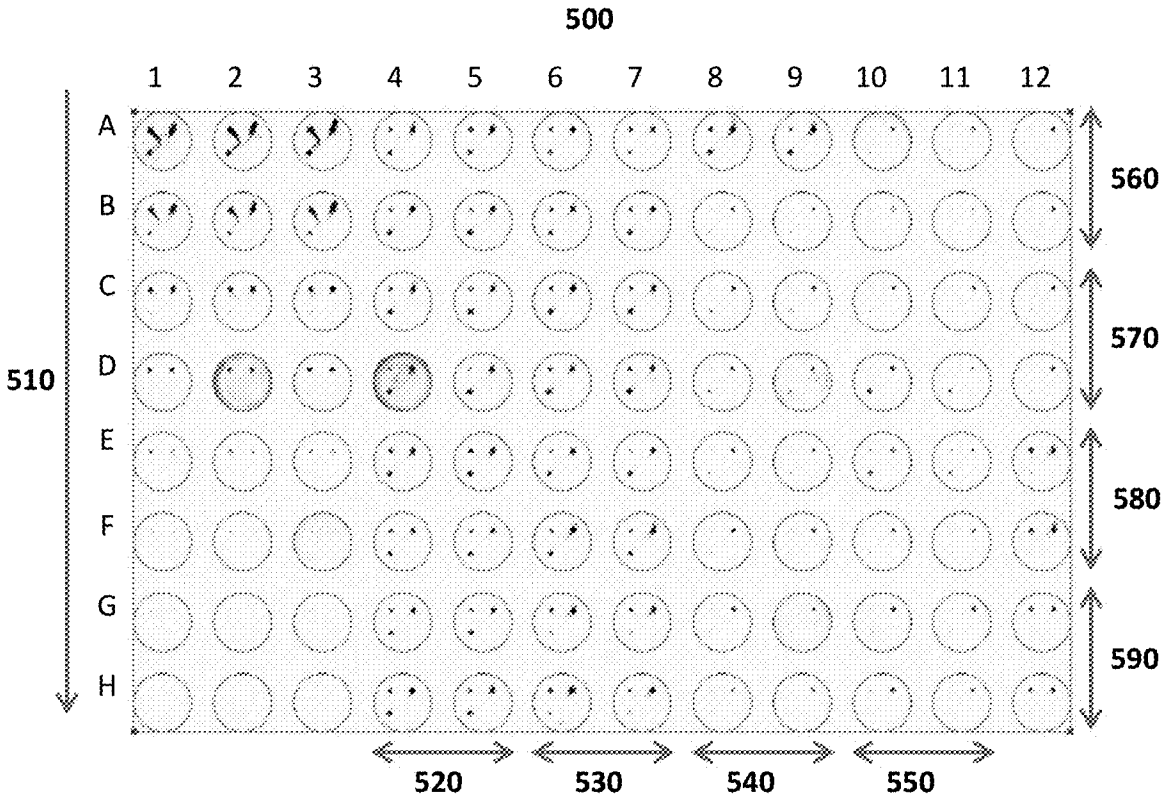
FIG. 8 shows multiwell plates with residual material after plate washing using other techniques.

For the first five plates run sequentially on the BioTek plate washer model number ELX405US with an attached plate loader model BIOSTACK2WR, no significant residue from contamination or ineffective removal of fluid were detected in plates 1-5. However, on subsequent plates 6-9 (as shown in FIGS. 6-8), residues remaining from the wash process can be seen in many wells. For example, FIG. 6 shows the results of plate 6 of 9 plates washed sequentially on a BioTek plate washer. Three distinct features are printed in each well. Calibration standards 310 were plated in duplicate in columns 1 and 2, and in duplicate in 360, 370, 380, and 390. Samples were plated in duplicate in 320, 330, 340, and 350. Following four wash cycles using aspiration needles, numerous wells showed varying degrees of artifacts, depicted as darker circular rings, which may have been caused by the dispense needles on the aspirator being contaminated or clogged. This produced dramatically different signal generation across identical wells. For example, wells A1 and A2 contained identical calibration standards, but produced different signals due to contamination. Similarly, wells A12 and B12, A4 and A5, B6 and B7, C6 and C7, A8 and A9, B8 and B9, D8 and D9, and F6 and F7 were identical samples that show different signals due to contaminated. Similar results may be seen on plates 7-8 (FIGS. 7-8).

EXAMPLE 2

Results with Wash Steps Disclosed Herein Using Automatic Plate Washing Systems

Example 2 describes the same methods in Example 1 for performing an ELISA assay using the Ciraplex® immunoassay kit, but where the plates were washed using an embodiment of the disclosed automatic plate washing system. The wash parameters were as follows. First, a plate was loaded onto the washer and dumped. The plates were then washed four times (filling the plate, dumping the contents of the plates, and then drying the plate on the absorbent material, as described for the exemplary embodiments described herein). The total wash time was less 120 seconds.

Figure 9:
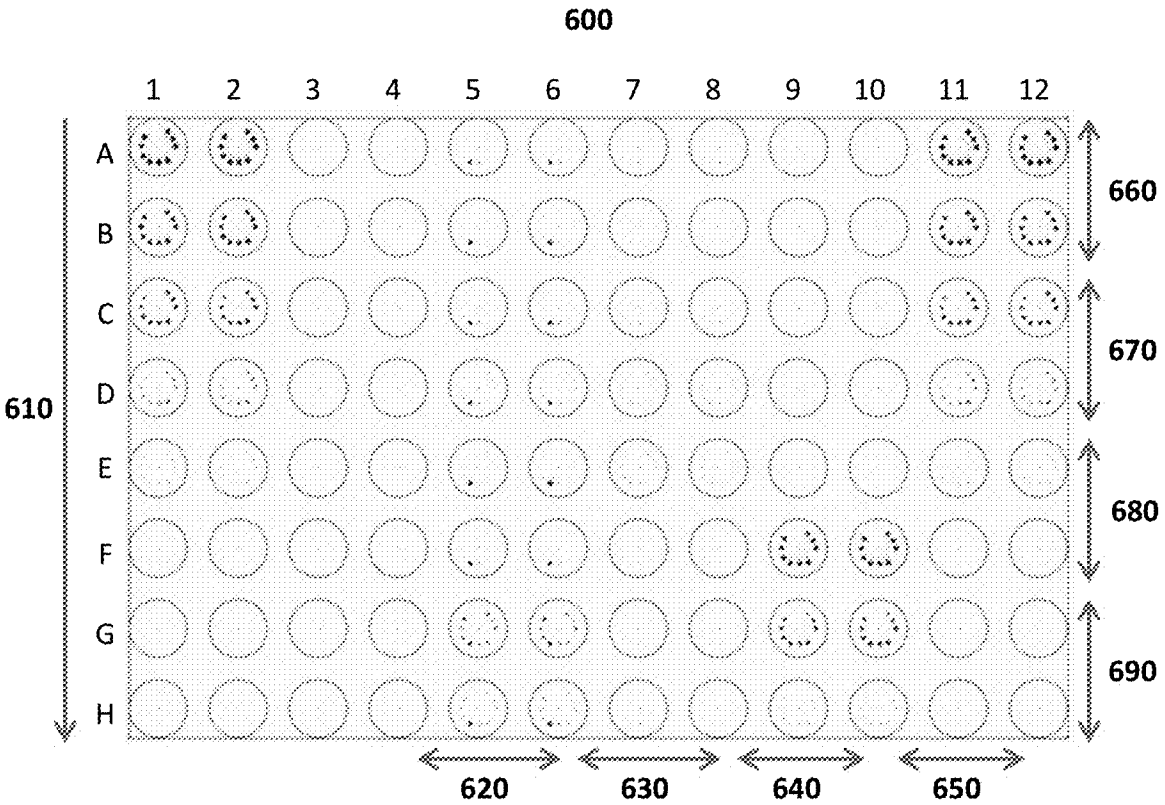
FIG. 9 shows multiwell plates after washing using a plate washing system according to an exemplary embodiment.

In contrast to the results in Example 1 and FIGS. 6-8, FIG. 9 shows exemplary plate 11 of 11 sequentially washed assay plates that were washed using an embodiment of the disclosed plate washing system. Calibration standards 610 were plated in duplicate in columns 1, 2, 11, and 12, and the rest of the wells were sample wells. FIG. 9 showed no visible contamination effects after the plates were washed using the automatic washing system for four cycles. Compared to the results with other wash steps described above, this plate washing system reduced the need to retest samples due to cross-contamination or ineffective removal of washing fluid.

EQUIVALENTS

While this disclosure has been particularly shown and described with references to embodiments thereof, it will be understood by those skilled in the art that various changes in form and details may be made therein without departing from the spirit and scope of the disclosure and the appended claims. Those skilled in the art will recognize, or be able to ascertain using no more than routine experimentation, many equivalents to the specific embodiments described specifically herein. Such equivalents are intended to be encompassed in the scope of the appended claims.

The invention claimed is:

1. An automated system for washing a multiwall plate, the automated system comprising:

an arm having a metal portion and having a multiwell plate holder for holding the multiwell plate;

a first rotational servo configured to rotate the multiwell plate about a first axis;

a second rotational servo configured to rotate the arm about a second axis; and a first electromagnet;

a first stop;

a fluid manifold adapted to dispense a wash fluid into a corresponding plurality of wells in the multiwell plate; and a controller configured to:

operate the first rotational servo as a first closed loop servo to rotate the multiwell plate about the first axis from an upward position to a downward position;

operate the second rotational servo as a second closed loop servo to rotate the arm about the second axis such that the metal portion moves towards the first electromagnet and to transition the second rotational servo to operating as an open loop servo; and activate the first electromagnet to cause the first electromagnet to pull the metal portion towards the first electromagnet while the second rotational servo operates as the open loop servo, wherein a deceleration impulse caused by the arm contacting the first stop dispels fluid in the multiwell plate.

2. The automated system for washing a multiwell plate of claim 1, wherein the first stop comprises the first electromagnet.

3. The automated system for washing a multiwell plate of claim 2, wherein the first electromagnet pulls the metal portion towards the first electromagnet and holds the metal portion against the first electromagnet.

4. The automated system for washing a multiwell plate of claim 1, wherein the metal portion comprises a metal plate.

5. The automated system for washing a multiwell plate of claim 1, further comprising at least one of a removal basin and an absorbent material, wherein the deceleration impulse caused by the arm contacting the first stop dispels fluid from the multiwell plate into the at least one of the removal basin and the absorbent material.

6. The automated system for washing multiwell plate of claim 5, wherein the automated system comprises both the removal basin and the absorbent material, and wherein the automated system further comprises:

a second electromagnet;

a second stop; and a linear servo configured to move the arm between the removal basin and the absorbent material;

wherein the controller is further configured to:

operate the second rotational servo as the second closed loop servo to rotate the arm about the second axis such that the metal portion of the arm moves towards the second electromagnet and transition the second rotational servo to operating as the open loop servo; and activate the second electromagnet to pull the metal portion of the arm towards the second electromagnet while the second rotational servo operates as the open loop servo, wherein a deceleration impulse caused by the arm contacting the second stop dispels fluid from the multiwell plate into at least the other of the absorbent material and the removal basin.

7. The automated system for washing a multiwell plate of claim 1, wherein the controller activates the first electromagnet 20 to 40 milliseconds before the arm contacts the first stop.

8. The automated system for washing a multiwell plate of claim 6, wherein the absorbent material is placed on top of a support for the absorbent material.

9. The automated system for washing a multiwell plate of claim 8, further comprising a source wheel that supplies clean absorbent material to the support.

10. The automated system for washing a multiwell plate of claim 8, further comprising a take-up wheel that removes used absorbent material from the support.

11. The automated system for washing a multiwell plate of claim 1, wherein the fluid manifold has a base and a plurality of dispense needles adapted to dispense the wash fluid into the corresponding plurality of wells in the multiwell plate, the fluid manifold configured to dispense the wash fluid across rows of columns of the multiwell plate.

12. The automated system for washing a multiwell plate of claim 1, wherein the arm is configured to move along a linear axis allowing movement of the multiwell plate underneath the fluid manifold.

* * * * *